US008314923B2

(12) United States Patent
York et al.

(10) Patent No.: US 8,314,923 B2
(45) Date of Patent: Nov. 20, 2012

(54) CONFIGURABLE RANGEFINDING DEVICES AND METHODS

(75) Inventors: Andrew W. York, Portland, OR (US); Eric Tyler Overstreet, Lake Oswego, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 109 days.

(21) Appl. No.: 12/841,042

(22) Filed: Jul. 21, 2010

(65) Prior Publication Data

US 2011/0021293 A1 Jan. 27, 2011

Related U.S. Application Data

(60) Provisional application No. 61/228,075, filed on Jul. 23, 2009.

(51) Int. Cl.
*G01C 3/08* (2006.01)

(52) U.S. Cl. ..... 356/4.01; 356/4.1; 356/5.01; 356/5.1

(58) Field of Classification Search ..... 356/3.01–3.15, 356/6–22, 28, 28.5, 139.01–139.1
See application file for complete search history.

(56) References Cited

U.S. PATENT DOCUMENTS 5,859,693 A 1/1999 Dunne et al.
6,738,148 B2 5/2004 Dunne et al.
7,654,029 B2 2/2010 Peters et al.
2007/0097351 A1 5/2007 York et al.
2007/0197314 A1* 8/2007 York et al. ..... 473/407

OTHER PUBLICATIONS

USGA, Decision 14-3/0.5 Local Rule Permitting Use of Distance-Measuring Device, http://www.usga.org/Rule-Books/Rules-of-Golf/Decision-14/#14-3/0.5, printed Jul. 20, 2010, 1 page.
USGA, USGA-R&A Joint Statement on Electronic Devices, Including Distance-Measuring Devices, Nov. 2009, 3 pages.
USGA, Rule 14-3 Artificial Devices, Unusual Equipment and Unusual Use of Equipment, http://www.usga.org/Rule-Books/Rules-of-Golf/Rule-14/, printed Jul. 20, 2010, 1 page.

* cited by examiner

*Primary Examiner* — Luke Ratcliffe
(74) *Attorney, Agent, or Firm* — Stoel Rives LLP

(57) ABSTRACT

Systems and methods are provided to selectively measure one or more conditions, such as temperature, wind speed, and angle of inclination, that may assist a golfer in making a play. If it is not permissible to present to the golfer additional information (e.g., an adjusted distance, temperature, wind speed, or a suggested club) that may assist a golfer in making a play, only a line-of-sight distance to a target on a golf course may be displayed. Modular rangefinders are also provided in which a dongle is coupled to a rangefinder to provide unique functionality. For example, a TGR™ dongle may provide golf specific functionality, such as calculating an adjusted distance that the golfer may use to play an inclined shot and a TBR® dongle may provide hunting specific functionality, such as calculating an equivalent horizontal distance that a hunter may use for precise shooting on an incline.

30 Claims, 15 Drawing Sheets

CONFIGURABLE RANGEFINDING DEVICES AND METHODS

RELATED APPLICATIONS

This application claims the benefit under 35 U.S.C. §119 (e) of U.S. Provisional Application No. 61/228,075, filed Jul. 23, 2009, which is hereby incorporated by reference in its entirety.

TECHNICAL FIELD

The field of the present disclosure relates generally to selectively configuring a rangefinder to provide unique functionality, such as golf specific functionality and shooting specific functionality.

BACKGROUND INFORMATION

Laser-based rangefinders for measuring a distance to a target, such as a pin on a golf course, are commercially available. In addition to presenting the measured distance, such rangefinders may also incorporate sensors, such as tilt sensors, for providing the user with additional information. According to Rule 14-3, Note and Decision 14-3/0.5 of the United States Golf Association (USGA) rules of golf, a device that measures a distance to the target may be permitted by local rules, but not a device that measures other conditions that might affect a user's play. Thus, rangefinders that provide additional information to the user are not typically allowed during tournament play and golfers may need to purchase two rangefinders—one for tournament play that measures distance only and another for recreational or training purposes that measures other conditions.

The present inventors have recognized a need for providing a single device that may be used for situations where only line-of-sight distance is permitted as well as for situations where additional information is permitted and desired.

DETAILED DESCRIPTION OF EMBODIMENTS

With reference to the above-listed drawings, this section describes particular embodiments and their detailed construction and operation. As one skilled in the art will appreciate, certain embodiments may be capable of achieving certain advantages over the known prior art, including one or more of the following: (1) aiding golfers to a greater extent; (2) providing golfers with swing speed guidance in addition to club selection guidance; (3) providing more accurate ranging by more accurately taking account of the effects of inclination; (4) providing a single device that may be used for recreational or training purposes as well as for tournament play under the USGA rules for golf; and (5) providing a system that is selectively configurable to operate in one or more of multiple modes of operation. These and other advantages of various embodiments will be apparent upon reading the following.

Figure 1:
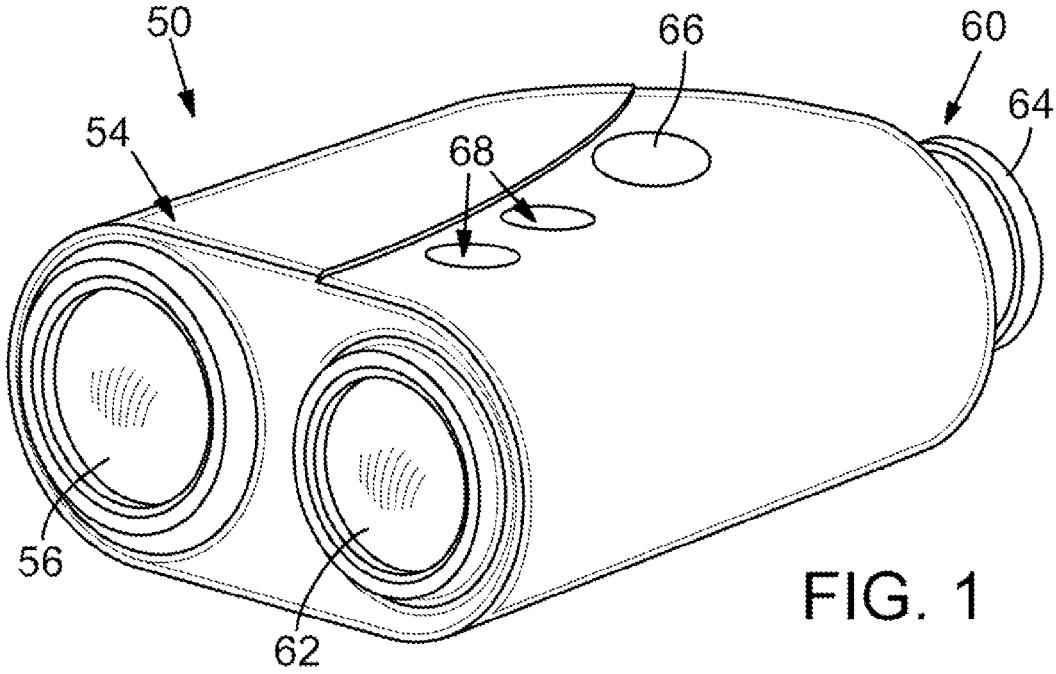
FIG. 1 is a perspective view of a rangefinding device, according to one embodiment.

FIG. 1 is a pictorial view of a device 50 according to one embodiment. The device 50 is a portable handheld rangefinder with special features and capabilities for use when golfing. In this version, the device 50 comprises a range sensor or rangefinder 54, which is a machine that measures the distance to a target. The rangefinder 54 may operate according to any suitable principle, such as, for example, sonar, radar, or laser reflectometry. Presently, use of a laser-based rangefinder is preferred for the rangefinder 54. A laser-based rangefinder typically emits laser pulses to the target and detects reflections of those pulses through a lens 56. By measuring the time between emission and detection of the reflection, a range can be calculated. The shape of the laser beam may be elongated in the vertical direction by use of beam-shaping optics, a scanning beam, etc., to enable better ranging to a pin or flag in a golf hole, although a spot laser beam or other beam shapes may be used. The rangefinder 54 may be targeted using an integrated optical targeting sight 60 including an objective lens 62 and an eyepiece 64, through which a user views the distant target. Objective lens 62 focuses an image of the target at a first (front) focal plane (not shown) located medially of objective lens 62 and eyepiece 64. An erector lens assembly (not shown) may be interposed between objective lens 62 and eyepiece 64 to invert the image and refocus it at a second (rear) focal plane (not shown) between the erector lens assembly and eyepiece 64. A part of the erector lens assembly may be movable in response to an optical power selector mechanism to adjust the optical power within a predetermined range of magnification.

A power button 66, when depressed, turns on certain electronics of the device 50 and causes the rangefinder 54 to emit laser pulses and acquire range readings. The device 50 also has a pair of menu interface buttons 68 for operating menus for inputting setup information and enabling functions of the rangefinder 54, as described in more detail in U.S. Patent Application Publication No. 2007/0097351, entitled "Rotary Menu Display and Targeting Reticles for Laser Rangefinders and the Like," filed Nov. 1, 2005, which is incorporated herein by reference.

Figure 2A:
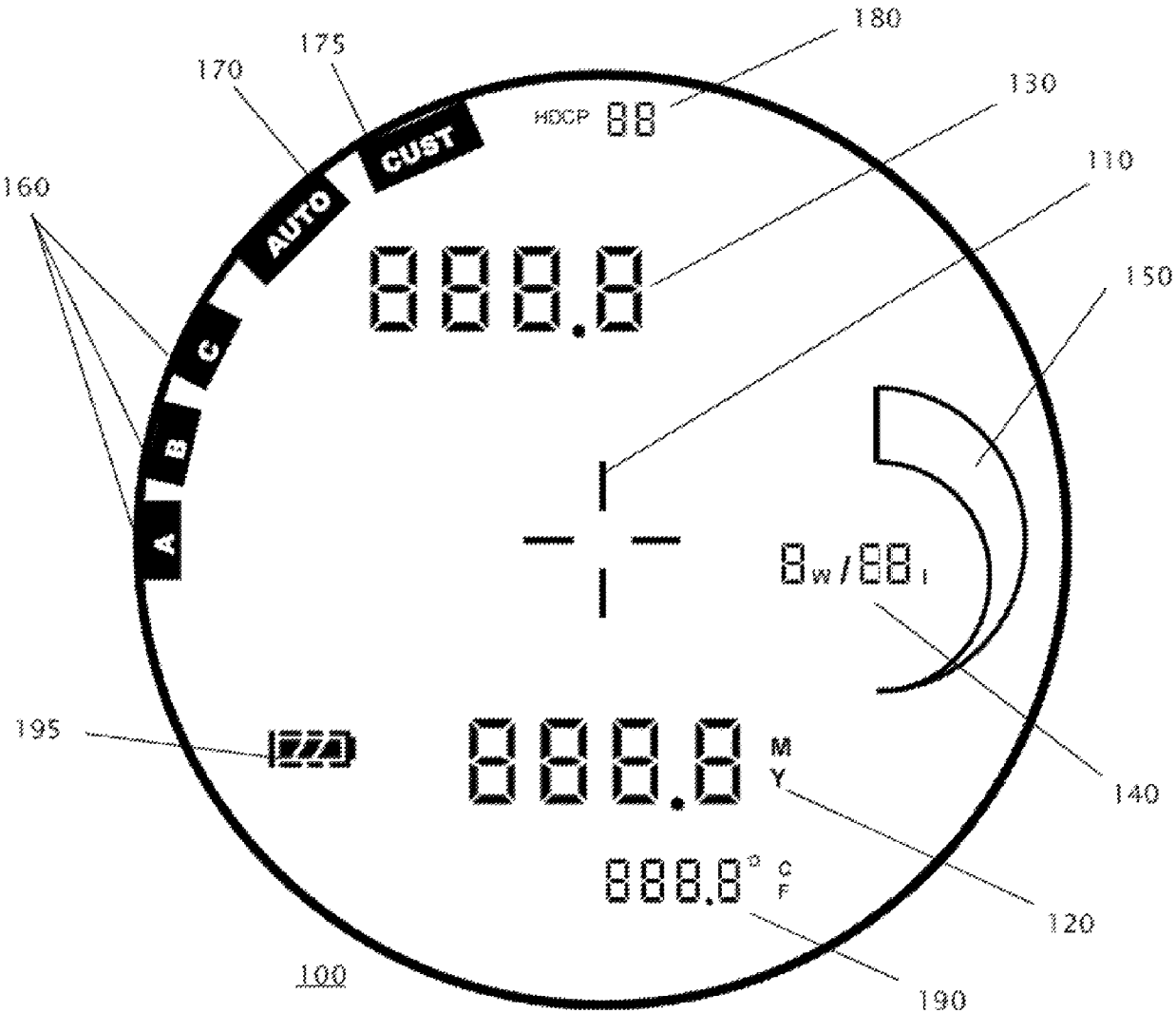
FIGS. 2A and 2B are enlarged views of electronic displays that may be viewed through the eyepiece of the device of FIG. 1.

FIG. 2A is an enlarged view of an electronic display 100 as may be viewed through the eyepiece 64 of the device 50, according to one embodiment. The display 100 is preferably placed in the field of view of the targeting sight 60 of the device 50. The display 100 may be formed by a transmissive LCD display panel placed between the objective lens 62 and the eyepiece 64 so as to not obscure the field of view. For example, the LCD panel may include transmissive electrodes formed of indium tin oxide (ITO). The visual elements on the display 100 (e.g., reticle 110, line-of-sight distance readout 120) may be reflective or opaque, or both, when active. A source of illumination (not shown) may optionally be provided for illuminating the active display elements to enhance their visibility in low ambient light conditions. The illumination source may be integrated in device 50 in such a manner so as to prevent illumination from being projected out of objective lens 62 toward the target. In other embodiments (not shown), display 100 may comprise any of a variety of visual display devices other than or in addition to an LCD display. For example, display 100 may comprise fiber optic displays, light emitting diodes (LEDs), organic light emitting diodes (OLEDs), active matrix liquid crystal displays (AMLCD) and others. Moreover, the display need not be located in the optical path. For example, a display such as an LCD, DLP, or another display outside of the optical path may project an image of the visual elements onto a prism or reversed beam splitter located in the optical path.

The display 100 may include a circular menu along its perimeter, which can be navigated using buttons the 66, 68 to select one or more of various functions of the device 50. The visual elements on the display 100 include a reticle 110, which indicates where the rangefinder 54 is pointed (i.e., where the laser beam of a laser-based rangefinder is directed) and thus where a measurement reading is taken. Below the reticle 110 is a line-of-sight distance readout 120, as measured by the rangefinder 54. This distance may be reported in meters, yards, or other units of length. Above the reticle 110 is a "true" distance readout 130. The true distance is calculated based on inclination measurements and possibly golf ball flight data to better account for the effects of elevation difference between the target and the golfer using the device 50. Details of those calculations are described below in this document. The display 100 may also include a suggested club indicator 140, which indicates a club that the device 50 recommends the golfer to use based on the line-of-sight distance, true distance, and possibly other factors. In addition, the display 100 furthermore may indicate a suggested swing speed for the golfer to hit the ball using the suggested club in order to reach or move toward the target. The suggested swing speed is preferably indicated by means of a swing meter 150 or other graphical scale. Algorithms for selecting a club and determining a swing speed are described below in this document.

Along the perimeter of the display 100 are ball type selections 160, denoted "A," "B," and "C" in FIG. 2A, corresponding to short, standard, and long-distance balls, respectively, for example. A greater or lesser number of ball types can be displayed. The user can make an appropriate selection to match the type of ball he or she is playing. The user can also choose between a default club selector 170 and a custom club selector 175. As described in greater detail below, the club selection and swing speed determination algorithms take into account range data for the various possible clubs. That data can be default values or can be customized data determined by training or programming the system for a specific user's golfing characteristics—in particular, his or her historical or expected hit distances for various clubs.

The display 100 may also include one or more hitter abilities (not shown). For example, a pro, men's, senior men's, women's, and senior women's hitter ability may be denoted "1," "2," "3," "4," and "5" respectively. A greater or lesser number of hitter abilities can be used and/or displayed. The user can make an appropriate selection to best reflect the one or more hitter abilities that best reflects their hitting ability. As described in greater detail below, the club selection and swing speed suggestion algorithms can take into account the hitter ability when recommending one or more clubs. According to one embodiment, each golf club has associated with it a hitting distance, or range of hitting distances, for each hitter ability. For example, a pro hitter ability may have a hitting distance of 310 yards (or a range of 290 to 330 yards) associated with a driver, a men's hitter ability may have a hitting distance of 255 yards (or a range of 250 to 280 yards) associated with a driver, and a women's hitter ability may have a hitting distance of 195 yards (or a range of 190 to 220 yards) associated with a driver. In another embodiment, data concerning club range is scaled by a factor based on the hitter ability. For example, a pro hitter ability may have a factor of 1.5, a men's hitter ability may have a factor of 1.3 and a women's hitter ability may have a factor of 1.0. Assuming a driver has a hitting distance of 200 yards (or a range of 195 to 205 yards) and the user indicates that they have a pro hitter ability, the range may be scaled by a factor of 50 percent (e.g., multiplied by 1.5) to approximately 300 yards (or a range of 293 to 308 yards).

According to yet another embodiment, a user may indicate that they belong to more than one hitting ability. For example, the hitting abilities may include short hitter, mid hitter, long hitter, male hitter, and female hitter. The user could indicate that he is a male hitter and then indicate that he has a long hitter ability, mid hitter ability, or short hitter ability. By way of example, a male short hitter may have a range of 200 to 230 yards with a driver, a male mid hitter may have a range of 230 to 260 yards with a driver, and a male long hitter may have a range of 260 to 290 yards with a driver. Likewise, a female may indicate that she is a female hitter. A female short hitter may have a range of 150 to 170 yards with a driver, a female mid hitter may have a range of 170 to 190 yards with a driver, and a female long hitter may have a range of 190 to 220 yards. Other hitter abilities may include a PGA pro, LPGA pro, and an amateur, for example. In addition, the user may input a profile for a set of clubs. For example, the user may indicate that they are long with irons but short with woods.

According to still another embodiment, the user may enter a hitting distance, or range of hitting distances, for all or a subset of the user's golf clubs. If the user enters a hitting distance for a subset of the user's golf clubs, a hitting distance for one or more of the other golf clubs may be calculated based on the hitting distance(s) of two or more golf clubs in the subset, such as by using known interpolation or extrapolation techniques. For example, if the user has a hitting distance of 150 yards with a 5-iron and 130 yards with a 7-iron, a hitting distance of 140 yards with a 6-iron and 160 yards with a 4-iron could be inferred for the user. According to a preferred embodiment, the user inputs a hitting distance for a 4-iron, 6-iron, and 8-iron and the device 50 interpolates hitting distances for the rest of the clubs. In addition, if the user enters hitting distance data for one golf club, a hitting distance for one or more of the other golf clubs may be calculated using a hitting distance increment between golf clubs. For example, if the user has a hitting distance of 150-yards with a 7-iron, a hitting distance of 160-yards with a 6-iron, 170-yards with a 5-iron, and 180 yards with a 4-iron can be calculated assuming a 10 yard increment between golf clubs. As discussed in greater detail with respect to FIG. 4, the user can enter some or all of their golf club information directly into device 50. In addition, the user can enter the information in other ways, such as via software that downloads data to device 50 using a wired or wireless connection.

Finally, the display 100 includes various other indicia, such as the user's handicap 180, current temperature 190 or other sensed condition such as angle of inclination with respect to the target, and a battery charge indicator 195. In other versions of the display 100, the visual elements may be re-arranged, some elements shown in FIG. 2A may be omitted, and/or additional elements (e.g., current score, number of strokes on current hole, date and time, etc.) can be displayed. The display 100 may also display other information relating to the device 50, such as control or setup information.

Figure 2B:
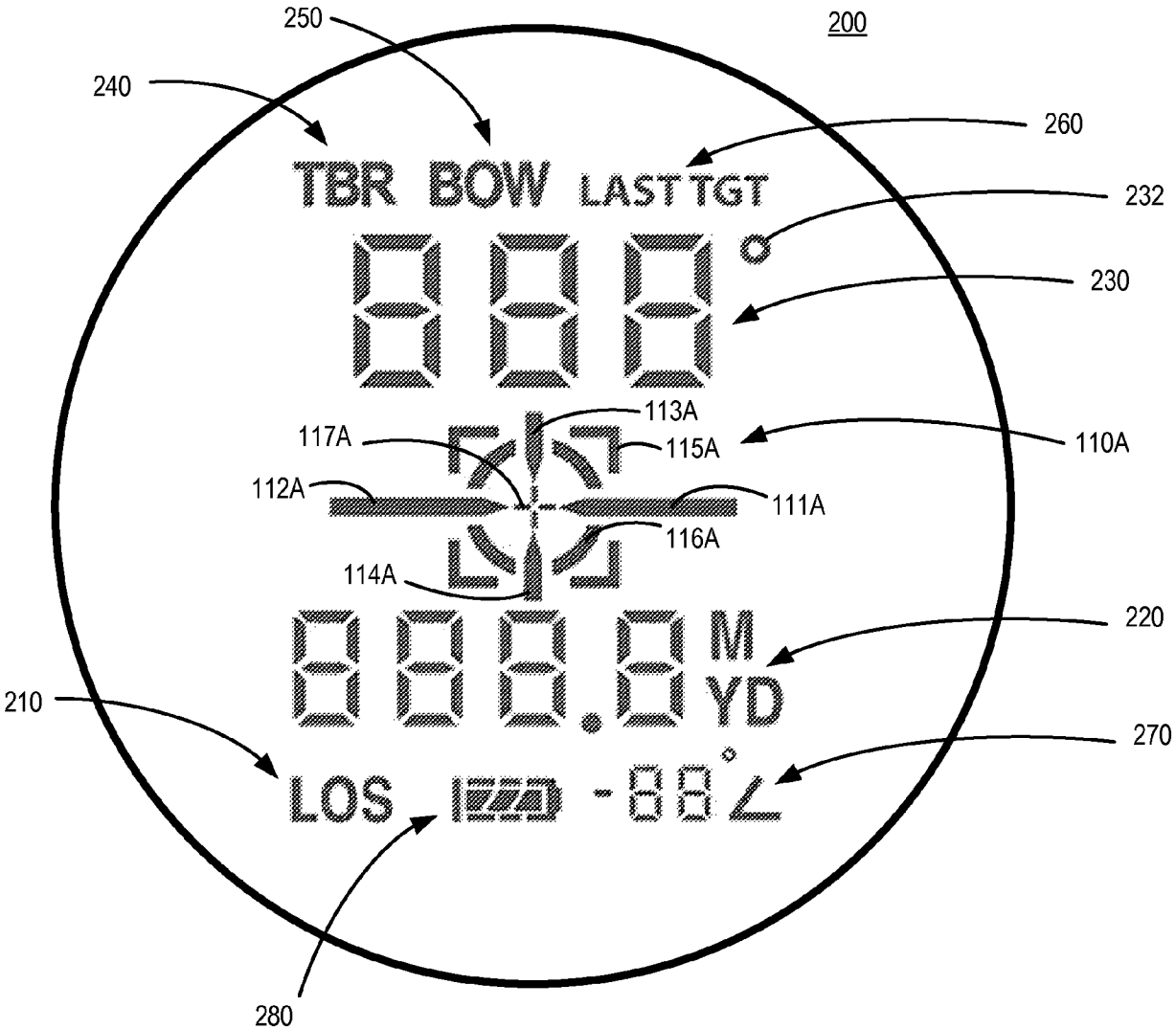
Figure 3A:
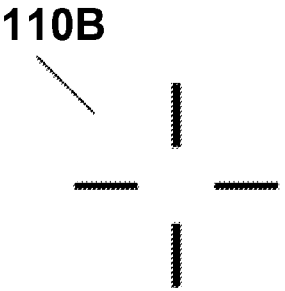
FIGS. 3A, 3B, 3C, 3D, and 3E are illustrations of various reticles for use on the display of FIG. 2A, FIG. 2B, or both.
Figure 3B:
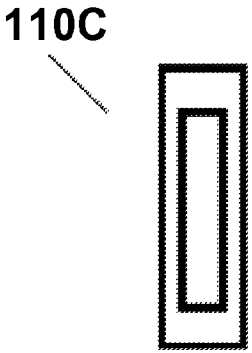
Figure 3C:
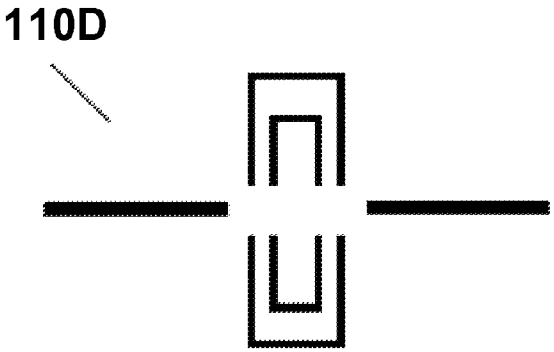
Figure 3D:
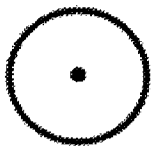
Figure 3E:
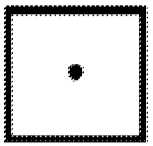

FIG. 2B is an enlarged view of an electronic display 200 as may be viewed through the eyepiece 64 of the device 50, according to another embodiment. The visual elements on the display 200 include a reticle 110A, which indicates where the rangefinder 54 is pointed and thus where a measurement reading is taken. To facilitate aiming at different distances and at different sizes and kinds of targets, reticle 110A may be selected from a variety of different possible reticle configurations. For example, reticle 110A may include various reticle elements or segments, such as horizontal radiating posts 111A and 112A, vertical radiating posts 113A and 114A, one or more angle brackets 115A, one or more curved brackets 116A, and a centered crosshairs or PLUS POINT™ 117A. The centered crosshairs 117A may be selected for small or distant targets, such as golf pins, golf holes, and varmints, and may include a void in the center to help avoid obscuring the target. The horizontal and vertical radiating posts 111A, 112A, 113A, and 114A may be selectively displayed, with or without the crosshairs 117A, to form a DUPLEX™ reticle (e.g., the horizontal and vertical posts 111A, 112A, 113A, and 114A are displayed) or a German #4 reticle (e.g., the horizontal posts 111A and 112A and the lower vertical post 114A are displayed, but not the upper vertical post 113A). A BRACKET SQUARE™ is formed by the four angle brackets 115A, with or without the crosshairs 117A, and may be sized to bracket an average elk torso at 40 yards or a deer torso at 30 yards. Similarly, a BRACKET CIRCLE™ is formed by the four curved brackets 116A, with or without the crosshairs 117A, and may be sized to bracket a smaller targets at 40 yards or a deer at 50 yards. When combined with posts 111A, 112A, 113A, and 114A, the BRACKET CIRCLE™ becomes a BRACKET CIRCLE DUPLEX™ and the BRACKET SQUARE™ becomes a BRACKET SQUARE DUPLEX™.

The display 200 also includes a lower data readout 220 below the reticle 110A and an upper data readout 230 above the reticle 110A. The data readouts 220 and 230 are responsive to processor 410 (FIG. 4), display driver 430, or both, to present data to the user. For example, the lower data readout 220 may display a distance measured by the rangefinder 54, which may be displayed in meters, yards, or other units of length. A LOS visual element 210 is displayed when the lower data readout 220 reflects a line-of-sight distance measured by the rangefinder 54.

The upper data readout 230 may display a "true" distance. The "true" distance may reflect a TRUE GOLF RANGE™ (TGR™), which includes an equivalent horizontal range, a true distance, or an adjusted distance calculated or determined based on one or more of inclination data, temperature data, altitude data, hitter ability data, and possibly other data, such as golf ball flight data, as described in more detail below. The "true" distance may also reflect a TRUE BALLISTIC RANGE™ (TBR™), which includes an equivalent horizontal range, a true distance, or an adjusted distance calculated or determined to help a hunter or shooter make a holdover or elevation adjustment for accurately aiming a projectile weapon at an elevated or depressed target. A TBR visual element 240 is displayed when the upper data readout 230 reflects a TBR™. A BOW visual element 250 is displayed when the upper data readout 230 reflects a TBR™ calculation or determination for archery (e.g., aiming information matched to the performance of a bow and arrow), which is described in more detail below. A TGR visual element may appear in place of the TBR visual element 240 if the upper data readout 230 reflects a TGR™.

Finally, the display 200 includes various other indicia, such as a LAST TGT visual element 260 to indicate when the upper data readout 230 displays the range to the furthest target (e.g., if a range is measured for more than one object), a degree visual element 232 to indicate when the upper data readout 230 displays a current temperature (or other sensed condition, such as angle of inclination), an angle of inclination visual element 270 for displaying a measured angle of inclination with respect to the target, and a battery charge indicator 280 for displaying a charge level of a battery. In other versions of the display 200, the visual elements may be re-arranged, some elements shown in FIG. 2B may be omitted, and/or additional elements (e.g., current score, number of strokes on current hole, date and time, other sensed conditions, data from a look-up table, etc.) can be displayed. The display 200 may also display other information relating to the device 50, such as control or setup information.

Various reticles are possible, some of which are shown for the sake of illustration in FIGS. 3A-3E. Preferably the user can select the desired reticle to be displayed on the display 100, display 200, or both. The device 50 may utilize different reticles under different conditions. For example, reticle 110B illustrated in FIG. 3A includes crosshairs having a transparent portion surrounding the point of intersection. This may help the user aim device 50 at a golf ball, golf green, golf hole, or pin or flag in the golf hole when rangefinder 54 emits a spot laser beam. Reticle 110C illustrated in FIG. 3B includes one rectangle inside of another rectangle. This may help the user aim device 50 at the pin or flag in a golf hole when rangefinder 54 emits a vertically elongated laser beam. Reticle 110D illustrated in FIG. 3C includes one rectangle inside of another rectangle. Both of the rectangles have a transparent portion along the center of the long axis of the rectangles. A horizontal crosshair extends laterally from the transparent portion. This may help the user aim device 50 at the golf ball, golf green, golf hole, or pin or flag in the golf hole when rangefinder 54 emits a spot laser beam or a vertically elongated laser beam. Reticle 110E illustrated in FIG. 3D includes a circle having an aiming point at its center. This may help the user aim device 50 at the golf ball, golf hole, or golf green when rangefinder 54 emits a spot laser beam. Reticle 110F illustrated in FIG. 3E includes a square having an aiming point at its center. This may help the user aim device 50 at the golf ball, golf hole, or golf green when rangefinder 54 emits a spot laser beam.

Figure 4:
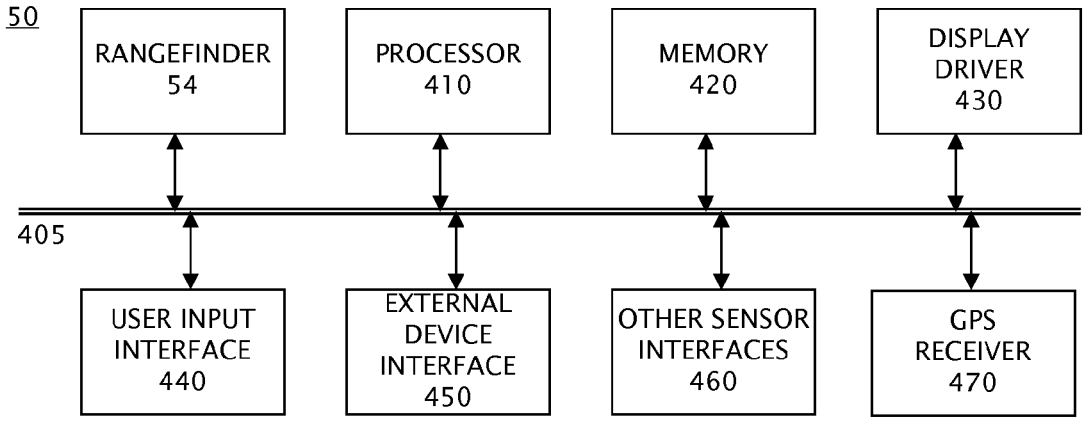
FIG. 4 is a functional block diagram of one illustrative architecture of the device for FIG. 1.

FIG. 4 is a functional block diagram of one illustrative architecture of the device 50. In FIG. 4, a bus-based architecture is illustrated, based on a bus 405. Other types of architectures are also suitable. A number of other components interface to the bus 405, including the rangefinder 54, a processor 410, a memory 420, a display driver 430, a user input interface 440, an external peripheral interface 450, other sensor interfaces 460, and a GPS (global positioning system) receiver 470. Other versions of the device 50 may have less than all of these components and/or may contain other components.

The processor 410 may be any form of processor and is preferably a digital processor, such as a general-purpose microprocessor or a digital signal processor (DSP), for example. The processor 410 may be readily programmable; hard-wired, such as an application specific integrated circuit (ASIC); or programmable under special circumstances, such as a programmable logic array (PLA) or field programmable gate array (FPGA), for example. Program memory for the processor 410 may be integrated within the processor 410, may be part of the memory 420, or may be an external memory.

The processor 410 executes one or more programs to control the operation of the other components, to transfer data between the other components, to associate data from the various components together (preferably in a suitable data structure), to perform calculations using the data, to otherwise manipulate the data, and to present results to the user. For example, the processor 410 preferably executes a club selection and swing speed determination algorithm.

The memory 420 may store default club distance data, custom club distance data, programs executed on the processor 410, and other data (e.g., map graphic files). The memory 420 may be permanent or removable.

The display driver 430 can interface with the processor 410 and the display 100 to present, for example, in textual and/or graphical form the club selection and swing speed suggestions calculated by the processor 410. Some versions of the system 100 may not include the display 100, in which case the display driver 430 may instead drive an external display wirelessly or via a wired connection. The external display may be a PDA (personal digital assistant), handheld computer, mobile phone, dedicated display unit for the device 50, printer, or the like.

The user input interface 440 may interface to one or more user input devices, such as the buttons 66 or other controls.

The external device interface 450 allows for connection to an external device, such as another computer, a display screen, a printer, etc. The external device interface 185 preferably provides an industry standard interface, such as a wireless or wired connection. In the case of a wired connection, a data bus may be provided using any protocol, such as Advanced Technology Attachment (ATA), Personal Computer Memory Card International Association (PCMCIA), and/or Universal Serial Bus (USB), for example. The wireless connection may use low powered electromagnetic waves to transmit data using any wireless protocol, such as Bluetooth™, WiFi, or IEEE 802.11, for example. Any of the components illustrated in FIG. 4 as being directly connected to the bus 405 may instead be external peripherals connected via the external device interface 450. For example, the rangefinder 54, rather than being directly connected to the internal bus 405, may be a separate external device connected via the external device interface 450.

One particular example of an electronic device connectable to the device 50 via the external device interface 450 is a computer, to which the device 50 connects as a peripheral. Such a computer may be a personal computer, a handheld computer such as a PDA (personal digital assistant) or smart mobile phone, or the like. Taking advantage of the external computer's expanded user interface can simplify certain data-entry tasks for the user, such as entering characteristics of the user's clubs (e.g., available irons, available woods, and associated face or loft angles), ball data, the user's distance performance characteristics (i.e., how far he or she hits the ball) for each club in the user's set, the one or more hitter abilities that best reflects their hitting ability, and data regarding course layout for a selected golf course. Club data (e.g., loft angles and default distances for the average user of such clubs), ball data, and course layout are preferably made available by the club or ball manufacturers or seller or golf courses for downloading by the user. Preferably the user enters several custom distances for each club by swing speed (or suitable approximation, such as hard swing, medium swing, soft swing) so that a swing speed profile can be constructed for each club. This data can be obtained by the user hitting balls at a driving range and noting the club used, speed of swing, and length of hit. Alternatively, the computer may execute a software program to query the user about his or her golf experience in order to deduce or estimate the user's distance data for various clubs. For example, data about the user's gender, height, weight, golf experience, handicap, etc. can be used to adjust default club-distance values.

Other sensors may optionally be a part of the device 50 or connectable to the device 50. Such other sensors include an inclinometer (i.e., tilt sensor), temperature sensor, a humidity sensor, an altimeter, an anemometer, a compass, and a barometer, for example. With knowledge of the variable(s) measured by the one or more sensors, the processor 410 can calculate the density of air or other parameters affecting a golf ball's flight.

The device 50 may also optionally include or be able to communicate with a GPS receiver 470, which can determine the location of the device in terms of latitude, longitude and altitude. In addition, device 50 and/or GPS receiver 470 may include an altimeter to provide altitude readings. Armed with that information and latitude-longitude-altitude data regarding possible targets on the golf course, the device 50 can compute line-of-sight distance and inclination without utilizing the rangefinder 54 or other sensors. The club selection and swing speed suggestion algorithms described herein can operate on such data, whether obtained from a GPS receiver, a rangefinder and inclinometer, or otherwise.

Figure 5:
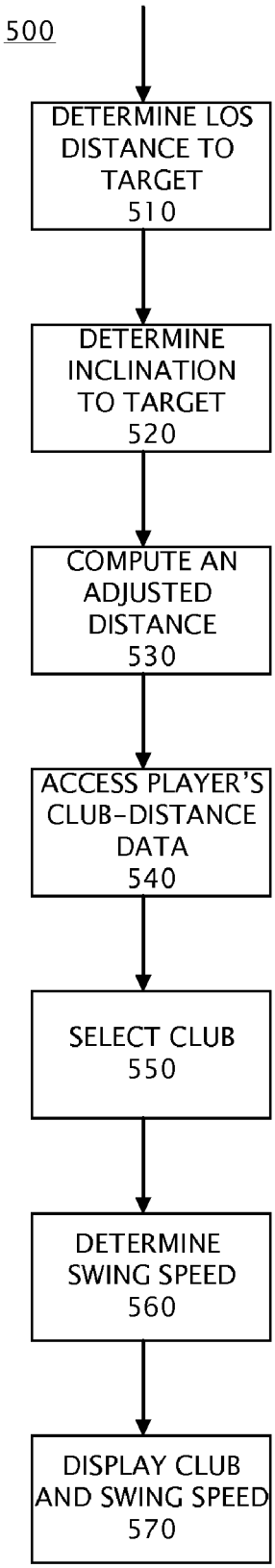
FIG. 5 is a flowchart of a method of using a rangefinding device, according to one embodiment.

FIG. 5 is a flowchart of a method 500 that may be preformed by or with the aid of the device 50, according to one embodiment. The method 500 determines (510) a line-of-sight (LOS) distance between the golfer (more particularly the device 50) and the target. This step is preferably performed using the rangefinder 54, but it may be performed in other ways. For example, using the GPS receiver 470 to determine the golfer's current location and accessing target position data, which may be supplied by the golf course, a processor can calculate a distance between those two points in space. As another example, a golfer with an electronic device can estimate the distance to the target or observe printed distance markers on the golf course and enter that distance in the electronic device, which can perform the method 500. The method 500 also determines (520) an inclination to the target with respect to the golfer or the device 50. The inclinationto-target measurement is preferably performed by a inclinometer or tilt sensor that is part of the device 50 and is preferably performed at the time of distance LOS ranging, but could be performed in other ways, such as by comparing the user's GPS position with map data. The method 500 may also determine other factors at step 520. For example, the method 500 may determine one or more of an altitude of the golfer above sea level (e.g., via an altimeter), a barometric pressure (e.g., via a barometer), an ambient temperature (e.g., via a temperature sensor), a relative humidity (e.g., via a humidity sensor), and wind speed and direction (e.g., via an anemometer and a compass). Instead of measuring the additional factors using a sensor, the additional factors may be accessed from a memory (e.g., the temperature and altitude may have been previously entered by the user or transferred to the device 50).

Figure 6:
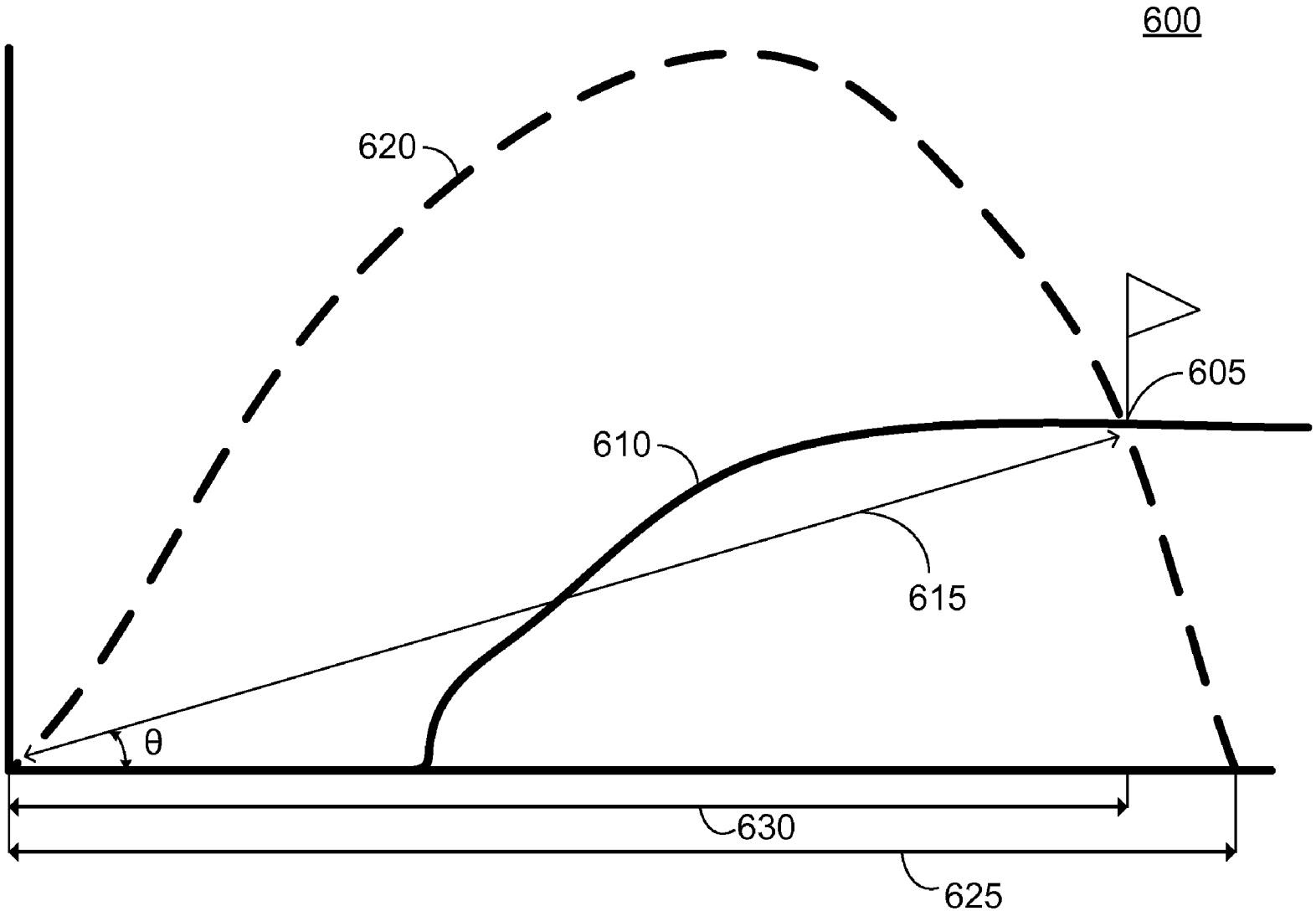
FIG. 6 is a diagram showing a trajectory of a golf ball.

Next the method 500 determines (530) an adjusted distance based on the LOS distance and the inclination (e.g., by performing a computation or retrieving a value from a lookup table). According to one embodiment, the adjusted distance may be an "equivalent horizontal range." With reference to FIG. 6, diagram 600 illustrates the pin or hole 605 located on a hill 610. For purposes of illustration, the trajectory curve 620, angle, and hill 610 are greatly exaggerated and not to scale. The pin 605 is elevated above the golfer (represented by the intersection of the x-axis and y-axis) at an angle of inclination of theta, θ. As previously described, method 500 determines (510) the LOS distance 615 between the golfer and the pin 605 and determines (520) an inclination theta, θ, to the pin 605 with respect to the golfer. A trajectory 620 of a golf ball depends on many factors, including the drag generated by the dimples on the ball, the spin rate of the ball, the terminal velocity of the ball, the wind force, the launch velocity, and ball bounce and roll on sloped ground. The equivalent horizontal range 625 helps the golfer determine the range at which the golfer should aim in order to reach a pin 605. For example, although the pin 605 is located a horizontal distance 630 from the golfer, for example 120 yards, the ball would fall short of pin 605 if the golfer hit the ball expecting it to travel 120 yards. By taking the trajectory of the ball into consideration, the equivalent horizontal range 625, for example 130 yards, may be calculated. Armed with the equivalent horizontal range 625, the golfer can hit the ball as though the pin 605 is 130 yards away on level ground. In addition, a predicted roll and bounce of the ball may be factored in. The trajectory of the ball may be based on the hitting ability of the golfer. For example, a first golfer (e.g., a strong hitter) may input the distances the first golfer can hit a 4-iron, 6-iron, and 8-iron and a second golfer (e.g., a weak hitter) may input the distances the second golfer can hit a 4-iron, 6-iron, and 8-iron and the method 500 may determine a trajectory of a golf ball based on the values input by the golfers. By way of example, if a pin is located 30 degrees below the golfer at a LOS distance of 183 yards, the method 500 may determine an equivalent horizontal range of 170 yards for the first golfer based on the hitting ability entered by the first golfer (e.g., the first golfer should use an 8-iron to break through a horizontal line at 170 yards so the ball continues downward to fall at the pin at 183 yards) and the method 500 may determine an equivalent horizontal range of 163 yards for the second golfer based on the hitting ability entered by the second golfer (e.g., the second golfer should use an 6-iron to break through a horizontal line at 163 yards so the ball continues downward to fall at the pin at 183 yards).

The equivalent horizontal range 625 is a function of the LOS distance and the angle of inclination, or f(LOS, θ). The trajectory 620 may be defined by a polynomial equation or set of polynomial equations that can be solved to determine the equivalent horizontal range 625 based on the LOS distance, the angle of inclination, and other factors. By way of example, knowing the LOS distance 615 and angle of inclination, θ, the elevation of the pin 605 above ground (e.g., the x-axis) may be calculated. Because the trajectory 620 of the ball may be thought of as a vertical and horizontal position over time, the curve and its polynomial equation may be solved to ensure that at the time the ball intersects with the range to the pin 605 (or some point before or after the pin 605 to accommodate for a predicted roll, bounce, or both, of the ball), it has an elevation (vertical position) approximately equal to the elevation calculated using the LOS distance 615 and angle of inclination, θ. An imaginary trajectory 620 can then be extended through the hill 610 to a point horizontally located from the golfer (e.g., where the ball would intersect the x-axis but for the hill 610). The equivalent horizontal range 625 can then be calculated as the horizontal distance between the golfer and the imaginary point at which the ball would have intersected the x-axis in the absence of any slope. In addition to the LOS distance, the angle of inclination, and the other factors described above, the equivalent horizontal range 625 may be a function of an initial velocity of a golf ball, an altitude of the golfer above sea level, a barometric pressure, an ambient temperature, a relative humidity, and possibly other factors.

Further, the adjusted distance may be a true distance analogous to TRUE BALLISTIC RANGE™, which is an equivalent horizontal range that takes into account inclination, as described in U.S. Pat. No. 7,654,029, entitled "Ballistic Ranging Methods and Systems for Inclined Shooting," filed Nov. 1, 2006, which is incorporated herein in its entirety. The principles disclosed in U.S. Pat. No. 7,654,029 are described with reference to bullet and arrow ballistics, but can be similarly applied to golf ball flight trajectories, the primary differences being in the aerodynamics of a golf ball as compared to a bullet, the dependence of take-off direction on the club used (higher numbered clubs resulting in a steeper take-off direction, and lower numbered clubs resulting in a more level take-off direction), and the dependence of initial ball velocity on swing speed. For a number of different club and swing speed combinations, the processor 410 or other suitable processor can determine a number of different calculated shot positions (e.g., vertical positions at the LOS range) using the equations and principles set forth above and in the above-referenced application and then choose the most appropriate combination or a few of the most appropriate combinations at steps 550 and 560 and display them at step 570. Iterative techniques can be applied to fine tune the swing speed to a more precise value for a given club. When there are multiple appropriate combinations, the displaying step 570 may cycle sequentially through the combinations of recommended club selection and corresponding swing speed for each club or display some or all of them simultaneously to the extent the display 100 has the space and capability to do so.

As part of the foregoing, the method 500 accesses (540) the player's club-distance data, which may be default values, custom values, values based on the hitter ability, or some combination of these.

Optionally, the method 500 may also determine a type of golf ball to use for the shot. Different golf balls have different flight or ballistic characteristics. Some balls are designed for maximum carry, others for shorter distances with more predictable flight. Thus, the club-distance data accessed at step 540 may be club-ball-distance data. Ball type is another variable that can be chosen and suggested to the golfer. In this case, the method 500 performs an additional step (not shown) to select a club. This may be performed, for example, by calculating final ball positions based on trajectory calculations for a number of different ball-club-swing speed combinations and choosing the closest one or closest few.

The method 500 may calculate and/or recommend only a club, both a club and a swing speed, both a club and ball type, all three, or any other combination of the three. Thus, the swing speed determining step 560 is optional. In addition, the method 500 may select (550), based on the hitter ability, the determined LOS distance, the adjusted distance, and/or the club-distance data, one or more recommended clubs. This may involve the additional steps (not shown) of selecting the hitter ability from multiple different hitter ability groups, for example a pro, men's, senior men's, women's, and senior women's hitter ability, and scaling the data concerning the hitting distances associated with the golf clubs by a factor based on the hitter ability.

In addition, the displaying step 570 may display other information, such as the LOS distance, the true distance, and other measured variables. For example, the temperature display 190 can alternately display inclination angle for a period of time, say, for example, about five seconds, before reverting to a temperature readout.

The device 50 may have additional capabilities, and the method 500 may perform other functions, not necessarily illustrated in the drawings. For example, the device 50 can include a handicap tracker and can display the player's handicap 190, as illustrated in FIG. 2A. As another example, the device may have a capability to count strokes by hole or by round, such as by activation of a button after each stroke, and update a cumulative score for the round with respect to par.

As yet another example, the device 50 can be used to range to the golf ball after the shot is completed. This can provide immediate feedback to the player regarding hitting distance. This measured range can also be used to supplement the player's club-distance database. Entries in this database can be time-stamped. When enough data is accumulated in the database, it better represents the user's abilities. If the data is time-stamped and sufficiently copious, then the accessing step 540 can filter the data, such as by a exponentially weighted window over time so as to give greater weight to more recent data. If compass bearing and inclination are also measured at the time of ranging to the hit ball, then the location of the hit ball can be calculated. This location can be displayed on a map to provide a graphical depiction of the user's play for a particular hole or an entire round. This calculated location can also be used to determine a range to the next target.

Selectively Compliant Rangefinders

According to still another example, the device 50 may be configured to display only the line-of-sight distance to a target on a golf course if it is not permissible to present to the player additional information (e.g., true distance, temperature, wind speed, or a suggested club) that may affect the player's attempt to move a ball toward the target (i.e., the user's play). By displaying only the line-of-sight distance to the target, the device 50 may comply with USGA Rule 14-3, and exceptions thereto, concerning rangefinders and other electronic distance measuring devices. According to Rule 14-3, the player must not use any artificial device or unusual equipment for the purpose of gauging or measuring distance or conditions which might affect his play.

However, the handicapping system permits players to use a device which measures distance only, but not a device that measures other conditions that may affect play, such as temperature, wind speed, or the slope of the ground. In addition, use of a device that measures distance only may be permitted by local rules according to USGA Rule 14-3, Note and Decision 14-3/0.5. Thus, by restricting information displayed to the line-of-sight distance and by not permitting a user to access the other device features (e.g., true distance, temperature, wind speed, or gradient), the devices and methods described below with reference to FIGS. 7-12 may comply with the USGA rules permitting rangefinders and other electronic distance measuring devices to be used for handicapping and where local rules exist. The embodiments depicted in FIGS. 7-12 and similar embodiments may provide an advantage by permitting a golf player to use a single multi-use device for situations where only line-of-sight distance is permitted as well as for situations where additional information is permitted and desired.

Figure 7:
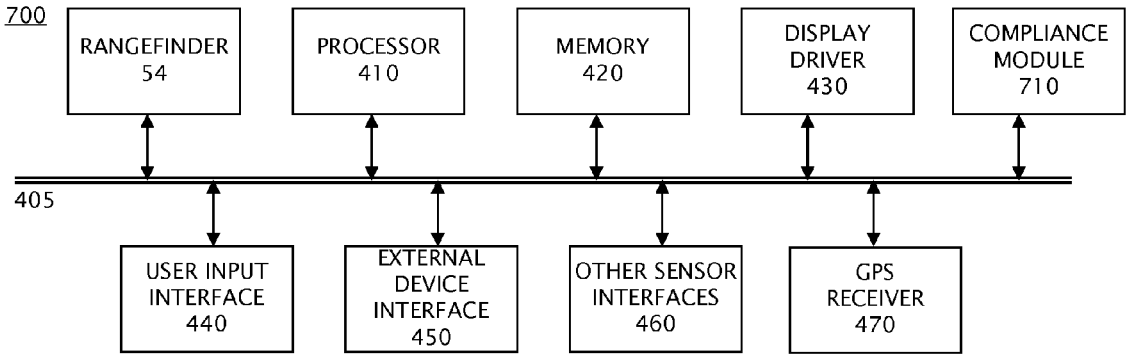
FIG. 7 is a functional block diagram of a device, according to another embodiment.

FIG. 7 is a functional block diagram a device 700, according to one embodiment. In FIG. 7, the device 700 is similar to the device 50 previously described with respect to FIG. 4, but includes a compliance module 710 for providing the processor 410 with an indication of whether it is permissible to measure one or more conditions affecting a play and thus present to the player additional information that may affect the player's attempt to move a ball toward the target. The compliance module 710 may be an external component attachable to and detachable from the device 700 or may be internal to the device 700. Thus, the compliance module 710 may comprise software, hardware, firmware, a receiver, a transmitter, a transceiver, or a combination thereof. According to certain embodiments, all or a portion of the compliance module may be stored in memory 420 for execution by processor 410. The processor 410 may also receive from other sources, such as the external device interface 450, the indication of whether it is permissible to measure the condition(s) affecting play and to present the additional information to the player. For example, the indication of whether it is permissible to measure the condition(s) affecting play and to present the additional information to the player may be received wirelessly by a golf course's wireless network or via a wired connection, such as when a player checks in for a golf tournament.

Figure 8H:
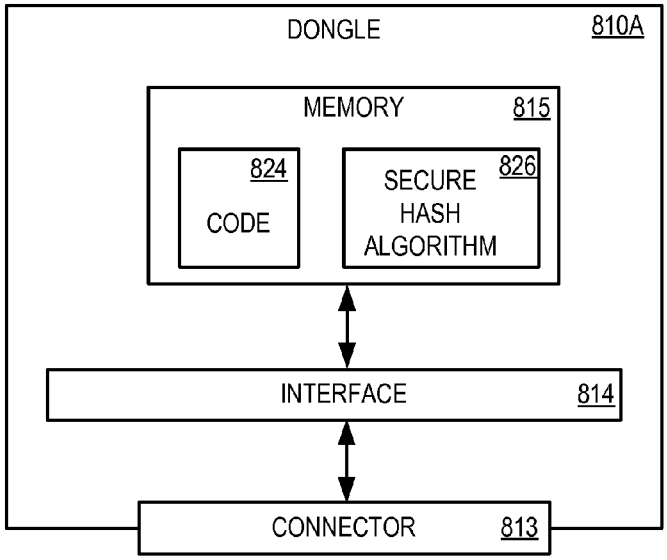
FIGS. 8H, 8I, and 8J are functional block diagrams of dongles, according to various embodiments.

FIGS. 8A-8G are various views of a rangefinding device 800 including a dongle or key 810, according to one embodiment. In FIGS. 8A-8G, the compliance module 710 comprises the dongle 810, which is connected to the device 800 via a connector 820, such as a USB connector associated with the external device interface 450. The device 800 is a portable handheld rangefinder with special features and capabilities for use with golfing as described or substantially as described with respect to the device 50 above. The dongle 810 comprises a pair of opposed pinch tabs 812, a connector 813 (which is obscured from view in FIGS. 8A-8G but is schematically illustrated in FIGS. 8H, 8I, and 8J) that mates with the connector 820 to communicatively couple the dongle 810 to the device 800, and hardware, software, firmware, or a combination thereof bearing instructions for processor 410 of whether it is permissible to measure one or more conditions affecting a play (and possibly bearing instructions of whether it is permissible to present the additional information to the player). According to one embodiment, the dongle 810 comprises a faceplate that is sized to have the same approximate height and width of the device 800. The faceplate may include an upper aperture sized so as to not obscure the objective lens 62 and a lower aperture sized so as not to obscure the lens 56. Thus, with reference to FIGS. 8A and 8D, the faceplate may be snap-fit to an objective-lens side of the device 800.

According to one embodiment, the opposed pinch tabs 812 include lateral side walls and interlocking shoulders that engage shoulder or flange protrusions of the device 800 (e.g., flange protrusions within recesses of the device 800 or extending from lateral side walls of the device 800) to attach and secure the dongle 810 to the device 800. The connector 813 on the dongle 810 and the connector 820 may comprise any suitable electrical connector that communicatively couples the dongle 810 to the device 800, such as a USB connector (e.g., a mini USB port or micro USB port), D-sub-miniature connector, edge connector, friction lock header, or other plug-and-socket or non-plug-and-socket connector. One or more mechanical seals 818 (see, e.g., FIGS. 8H, 8I, and 8J), such as a gasket or O-ring, may be provided between the dongle 810 and the device 800 to provide an air tight connection, water tight connection, or both, when the dongle 810 is attached to the device 800 so that water and dirt do not become lodged in the connector 820 and do not enter the housing of the device 800. According to one embodiment, a blank key is provided for attachment to the device 800 if the dongle 810 is not being used to help prevent water and dirt from becoming lodged in the connector 820 and from entering the housing of the device 800. The blank key preferably has the same approximate dimensions as the dongle 810 but is colored differently to help distinguish the blank key from the dongle 810 (e.g., the dongle 810 may be colored a florescent yellow while the blank key has a chrome finish or is colored black). The blank key may omit any combination of the connector 813 that mates with the connector 820 or the hardware, software, or firmware bearing instructions for processor 410 of whether it is permissible to measure one or more conditions affecting a play.

The dongle 810 may be attached to the device 800 or removed from the device 800 to enable or disable one or more features of the device 800. The dongle 810 (or the blank key) may be removed from the device 800 by depressing the pinch tabs 812 and pulling the dongle 810 away from the device 800. The dongle 810 (or the blank key) may be attached to the device 800 by aligning the connector 813 with the connector 820 and pushing the dongle 810 toward the device 800 so that the interlocking shoulders on the pinch tabs 812 engage the flange protrusions of the device 800 (e.g., the dongle 810 may be snap-fit to the device 800). The dongle 810 is preferably configured to provide the processor 410 with the indication of whether it is permissible to measure one or more conditions affecting a play. For example, the device 800 may run in a restricted mode until the dongle is connected to the device 800. When operating in the restricted mode, the device 800 may display (e.g., via display driver 430 and display 100 or 200) the line-of-sight data and other permitted data without displaying additional information that might assist a player in making a stroke or play, such as displaying an effective distance between two points (e.g., a distance after considering gradient, wind speed, wind direction, temperature, or other environmental factors) or recommending a club selection, a type of shot to be played (e.g., a punch shot or a pitch and run), or a recommended line of putt. The other permitted data may include, for example, information on advice-related matters that was produced prior to the start of a player's round (e.g., an electronic yardage book or swing tips), playing information from previous rounds (e.g., driving distances and individual club yardages), and information related to a competition being played (e.g., the leader board or projected cut).

After being connected to the device 800, the dongle 810 may provide the processor with an indication that it is permissible to measure one or more conditions affecting a play. In other words, a set of sensors, such as one or more of an inclinometer, a temperature sensor, a humidity sensor, an altimeter, an anemometer, a compass, and a barometer, may be disabled until the dongle 810 has been connected to the device 800 (i.e., the dongle 810 enables one or more of the sensors). In another embodiment, the opposite is true (i.e., inserting the dongle 810 disables one or more of the sensors). In still another embodiment, the dongle 810 is configured to provide the processor 410 with an indication of whether it is permissible to present additional information (e.g., a variable measured by one of the sensors or a calculated true distance) to the player. Thus, in some embodiments one or more of the sensors may be enabled regardless of whether the dongle 810 is connected to the device 800 and the dongle 810 functions merely to permit the device 800 to display (or prevent the device 800 from displaying) additional information that may affect the player's attempt to move a ball toward the target.

The dongle 810 may include hardware, software, firmware, or a combination thereof bearing instructions for processor 410 of, whether it is permissible to measure one or more conditions affecting a play, bearing instructions of whether it is permissible to present the additional information to the player, or both. For example, FIG. 8H illustrates a dongle 810A, which includes a memory 815 that stores a code 824 (e.g., data, such as text or a numeric value, indicating that the inclinometer and TGR algorithm may be activated) and a secure hash algorithm or engine 826 (e.g., a 64-bit secure hash algorithm (SHA-1) or a 512-bit SHA-1). According to one embodiment, the processor 410 (or another component, such as a co-processor) is configured to authenticate one or more of the dongle 810A, the code 824, or the user of the dongle 810A. For example, the processor 410 may perform a challenge-response authentication in which the processor 410 presents a challenge to the dongle 810A and the dongle 810A provides a response that is authenticated by the processor 410. The challenge-response authentication may follow any number of protocols, such as key-based authentication or password authentication. The password authentication may, for example, involve the processor 410 prompting the dongle 810A (or a user) for a password and the dongle 810A (or the user) responding with the password, which is authenticated by the processor 410.

The memory 815 illustrated in FIG. 8H, may be implemented using one or more standard memory devices, such as RAM, ROM, EEPROM, or magnetic or optical storage devices. According to one embodiment, the memory 815 comprises a secure memory device having stored therein the code 824 and the secure hash algorithm or engine 826. One suitable secure memory device is the model DS28E01-100 EEPROM offered by Maxim Integrated Products, Inc., Sunnyvale, Calif., for example. The connector 813 may comprise any of the connectors described with reference to FIGS. 8A-8G. The dongle 810A may also include an interface 814, which facilitates data input and output through the connector 813 when the dongle 810A is connected to the device 800. Because the dongle 810A may be attached to the connector 820 associated with the external device interface 450, the interface 814, the external device interface 450, or both, may include hardware, software, firmware, or any combination thereof that implements one or more protocols, such as stacked protocols, along with corresponding layers, so that the connector can function as a serial port (e.g., RS232), a USB port, or an IR interface. Of course, the interface 814 may also support various wired, wireless, optical, and other communication standards. In certain embodiments, one or more of the connector 813 or the interface 814 may be omitted.

According to one embodiment, each time a user pushes a ranging button on the device 800, the device 800 determines whether the dongle 810A having the code 824 stored thereon is coupled to the device 800. For example, after the user pushes the ranging button, the device 800 may interrogate the dongle 810A to determine whether to activate methods for providing information to help the user play a shot (e.g., determine an equivalent horizontal range, true distance, or an adjusted distance based on the angle of inclination, the altitude, temperature, and hitting strength of the user). If a dongle is coupled to the device 800, the device 800 may determine whether the dongle has stored thereon a code (e.g., the code 824 on the dongle 810A) indicating that an inclinometer and TGR algorithm, for example, may be activated. If the device 800 determines that the dongle has stored thereon a code indicating that the inclinometer and TGR algorithm may be activated, the device 800 activates the inclinometer and TGR algorithm. If, on the other hand, the device 800 determines that the dongle does not have stored thereon a code indicating that the inclinometer and TGR algorithm may be activated, the device 800 may display only the line-of-sight distance (e.g., function in a LOS mode) so that the device 800 may comply with USGA Rule 14-3. Thus, the device 800 is not designed to function in violation of USGA Rule 14-3 unless the dongle 810A having the code 824 stored thereon is connected to the device 800. The dongle 810A may have imprinted thereon (e.g., on a housing of the dongle 810A) a message indicating that the device 800 does not conform to the USGA Rules of Golf when the dongle 810A is connected to the device 800.

FIG. 8I illustrates a dongle 810B, which includes a memory 817 for storing encrypted or unencrypted data 821, one or more program modules, components, or applications 822, or both. According to one embodiment, the device 800 is configured to authenticate (e.g., via the processor 410 or another component, such as a co-processor) one or more of the dongle 810B, all or a portion of the data 821, or the user of the dongle 810B. For example, the device 800 may perform a key-based authentication in which a message authentication code (MAC) is generated from an input message and a secret code stored in memory 817 (and possibly additional input data) using a hash function or algorithm stored in memory 817, another MAC is generated from the input message and a secret code stored in memory 420 (and possibly additional input data) using a hash function or algorithm stored in memory 420, and the generated MACs are compared. If the generated MACs match (which should be the case if the hash functions are identical, the secret codes are identical, the messages are identical, and the additional input data are identical), the dongle 810B is authenticated. The additional input data may comprise a random input, such as a random number generated by the processor 410, and a unique ROM identification number. The hash functions stored in memories 817 and 420 may comprise secure hash algorithms, such as a type 1 secure hash algorithm (SHA-1).

The hash function stored in memory 817 (e.g., one of the applications 822 may comprise a SHA-1 engine) may be executed by the processor 816 or the processor 410. If the hash function stored in memory 817 is executed by the processor 816, the memory 817 and the processor 816 may be integrated into a coprocessor having EEPROM securely storing the SHA-1 engine and secret code. One suitable coprocessor is the model DS2460 coprocessor offered by Maxim Integrated Products, Inc., Sunnyvale, Calif. (http://www.maxim-ic.com), for example. If, on the other hand, the hash function stored in memory 817 is executed by the processor 410, the memory 817 may comprise a secure memory device, such as an EEPROM having stored therein the SHA-1 engine and a secret code. Suitable secure memory devices the models DS28E01-100 and DS2432 EEPROMs offered by Maxim Integrated Products, Inc., Sunnyvale, Calif., for example. The DS28E01-100 and DS2432 secure memory devices include a SHA-1 engine, a secret key (e.g., a 64-bit secret) that can be used for internal chip operations (but cannot be read from outside the secure memory device), a unique ROM registration number, and a data memory for storing to-be-authenticated data (e.g., a message). In addition to the processor 410, the device 800 may also include a coprocessor (e.g., a DS2460 SHA-1 coprocessor) to offload the task of computing SHA-1 MACs by the processor 410. Using a coprocessor in addition to the processor 410 allows the secret code on the device 800 to be stored in the secure memory of the coprocessor rather than the program code of the device 800 and may also help reduce the processing power needed for the processor 410.

According to one embodiment, the device 800 authenticates the dongle 810B according to the following example. After the user pushes a ranging button on the device 800, the device 800 interrogates the dongle 810B to determine whether to activate methods for providing information to help the user play a shot (e.g., determine an equivalent horizontal range, true distance, or an adjusted distance based on the angle of inclination, the altitude, temperature, and hitting strength of the user). For example, the device 800 may determine whether the dongle 810B has stored thereon a TGR code (e.g., data, such as text or a numeric value, indicating that the inclinometer and TGR algorithm can be activated), which may be authenticated by the device 800. In other words, instead of simply checking the dongle 810B for the TGR code, the device 800 will attempt to authenticate the TGR code. Before describing how the device 800 authenticates the TGR code, the components used in the authentication process will be described. An authentic dongle 810B may have, for example, a secret code, hash function (e.g., a SHA-1 engine), and TGR code (which will be authenticated by the device 800) stored thereon (e.g., in memory 817). The device 800 may also have its own secret code, hash function, and possibly the TGR code stored thereon (e.g., in memory 420).

To authenticate the TGR code, the processor 410 generates a random input (e.g., a random number) and computes (using the SHA-1 engine stored on the dongle 810B) a dongle MAC from the random input, the secret code on the dongle 810B, the TGR code, and possibly other data, such as a unique ROM identification number. If the dongle 810B includes a processor 816, the device 800 may instruct the dongle 810B to compute the dongle MAC (instead of having the processor 410 compute the dongle MAC). The processor 410 then computes a device MAC. In other words, the processor 410 computes (using the SHA-1 engine stored on the memory 420) a device MAC from the random input, the secret code on the device (e.g., stored on the memory 420), the TGR code, and possibly the other data. The processor 410 may then compare the computed dongle MAC with the computed device MAC. If the device MAC matches the dongle MAC, the dongle 810B is authenticated (in which case the inclinometer and TGR algorithm can be activated). It should be noted that the secret codes and the SHA-1 engines are not transferred between the device 800 and the dongle 810B. Thus, an authentic dongle 810B will include its own secret code and hash function that matches the secret code and hash function of the device 800. Including the random number in the challenge helps avoid a non-authentic dongle from simply replaying a dongle MAC (instead of computing the dongle MAC). In other words, a valid static dongle MAC cannot simply be recorded when an authentic dongle is queried by the device 800 and stored on a non-authentic dongle to be replayed when the non-authentic dongle is queried. If the device MAC does not match the dongle MAC, the dongle 810B is not authenticated (in which case the inclinometer and TGR algorithm will not be activated). In other words, if the device and dongle MACs do not match, the device 800 will display only the line-of-sight distance (e.g., function in a LOS mode) so that the device 800 may comply with USGA Rule 14-3. Thus, the device 800 is not designed to function in violation of USGA Rule 14-3 unless an authentic dongle 810B is connected to the device 800. Because the secret code stored on dongle 810B is read-protected and the challenge is based on a random number, it is unlikely that a non-authentic dongle can be connected to the device 800 to activate the inclinometer and TGR algorithm. The dongle 810B may have imprinted thereon (e.g., on a housing of the dongle 810B) a message indicating that the device 800 does not conform to the USGA Rules of Golf when the dongle 810B is connected to the device 800.

Instead of or in addition to authenticating the dongle 810B, the processor 410 may be configured to search for encrypted or unencrypted data 821, an application 822 stored on the dongle 810B, or both. For example, a dongle may have stored thereon data that was computed using a hash algorithm (e.g., a SHA-1 engine) and the device 810 may be configured to search for that data. Configuring the processor 410 to authenticate the dongle 810B or search for data 821 or an application 822 stored on the dongle 810B may allow golf course operators, the USGA, or the PGA to keep tight control over which devices are allowed to measure one or more conditions affecting a play (e.g., the player cannot simply plug a USB flash drive into the device 800 to enable one or more of the sensors).

The data 821 may include an indication of which sensor or sensors to enable or disable (e.g., enable the rangefinder 54 but not the inclinometer), an indication of the information that may be presented to the player (e.g., display LOS distance but not the adjusted distance), or any combination thereof. The one or more program modules or components 822 may comprise a set of instructions that implement, for example, one or more of the functionalities described herein, such as all or a portion of the method 500. In other words, the device 800 may not include instructions to determine an adjusted distance or recommend one or more of a club, swing speed, or ball type, until the dongle 810B is attached the device 800. If the device 800 does not include instructions to determine an adjusted distance or recommend one or more of a club, swing speed, or ball type, the device may comply with a local rule allowing the use of a distance-measuring device pursuant to the note in USGA Rule 14-3 because the device would not have the capability to assist in calculating the effective distance between two points (e.g., the distance after considering gradient, wind speed, wind direction, temperature, and other environmental factors) or assist the player by recommending, for example, a club to use unless the dongle 810B including such instructions is attached to the device 800. The one or more program components 822 may also comprise a set of instructions that authenticates or verifies whether it is permissible to measure one or more conditions affecting play, whether it is permissible to present additional information to the player, or both (e.g., an authentication module). For example, after inserting the dongle 810B, the processor 410 (or a processor on the dongle 810B, such as processor 816) may execute instructions that cause the display 100 to prompt a user (e.g., a player or an official) to enter an access code (e.g., via buttons 66 and 68 on the device 800 or one or more buttons provided on the dongle 810B). After the user enters the access code, the processor 410 determines whether the access code entered by the user is valid (e.g., by comparing the entered access code to data 821 or data stored in memory 420) and if so, enables, for example, one or more sensors (e.g., the inclinometer) so that one or more conditions affecting play can be measured.

The memory 817 may be implemented using one or more standard memory devices, such as RAM, ROM, EEPROM, or magnetic or optical storage devices. According to one embodiment, the memory 817 comprises a secure memory device having stored therein a secure hash algorithm (SHA-1) engine. One suitable secure memory device is the model DS28E01-100 EEPROM offered by Maxim Integrated Products, Inc., Sunnyvale, Calif., for example. The dongle 810B may optionally include a processor 816 for executing one or more programs to control the operation of the other components, to transfer data between the other components, to associate data from the various components together (preferably in a suitable data structure), to perform calculations using the data, to otherwise manipulate the data, and to present results to the user. For example, the processor 816 may execute the program modules or components 822. The processor 816 may be readily programmable; hard-wired, such as an application specific integrated circuit (ASIC); or programmable under special circumstances, such as a programmable logic array (PLA) or field programmable gate array (FPGA), for example. According to one embodiment, the processor 816 comprises a coprocessor having EEPROM that securely stores a SHA-1 engine and a secret code. One suitable coprocessor is the model DS2460 coprocessor offered by Maxim Integrated Products, Inc., Sunnyvale, Calif., for example.

The dongle 810B may also optionally include an interface 814, which facilitates data input and output through the connector 813 when the dongle 810B is connected to the device 800. Because the dongle 810B may be attached to the connector 820 associated with the external device interface 450, the interface 814, the external device interface 450, or both, may include hardware, software, firmware, or any combination thereof that implements one or more protocols, such as stacked protocols, along with corresponding layers, so that the connector can function as a serial port (e.g., RS232), a USB port, or an IR interface. Of course, the external device interface 450 may also support various wired, wireless, optical, and other communication standards.

FIG. 8J illustrates a dongle 810C, which includes one or more circuits 819. Thus, the processor 410 may be configured to authenticate or identify one or more of the circuits 819 to determine whether it is permissible to measure one or more conditions affecting a play, determine whether it is permissible to present the additional information to the player, or both. The one or more circuits 819 may also comprise a set of sensors, such as one or more of an inclinometer, a temperature sensor, a humidity sensor, an altimeter, an anemometer, a compass, and a barometer. Thus, according to one embodiment, the dongle 810C (not the device 800) includes one or more sensors to measure, for example, wind speed, gradient, or temperature. Accordingly, the device 800 may comply with a local rule allowing the use of a distance-measuring device pursuant to the note in USGA Rule 14-3 because the device would not have the capability of gauging or measuring other conditions that might affect play (e.g., wind speed, gradient, and temperature) unless the dongle 810C including one or more sensors is attached to the device 800. According to another embodiment, the processor 410 is configured to enable one or more of the sensors (or present the additional information) after determining that a dongle, such as dongle 810, 810A, 810B, or 810C, has been attached to the device 800 (e.g., by monitoring status bits that report the attachment or removal of a USB device) without identifying a specific circuit on the device or without searching for data or an application stored on the device.

Other versions of the dongles 810, 810A, 810B, and 810C may omit one or more components, may contain additional components, or both. For example, any of the dongles 810, 810A, 810B, and 810C may include the processor 816, one or more sensors, or one or more user input devices, such as one or more buttons or other controls, along with associated input/output controllers. In addition variations may be made to any of the dongles 810, 810A, 810B, and 810C. For example, the one or more program modules 822 and data 821 may be stored on the dongle, the device 800, or a combination of the dongle and the device 800. By way of another example, the mechanical fastener 812 may comprise the opposed pinch tabs described with reference to FIGS. 8A-8G or may comprise another device or coupling that mechanically joins or affixes two or more objects together, such as a latch, mating nut and bolt, or hook-and-loop fastener.

Figure 8A:
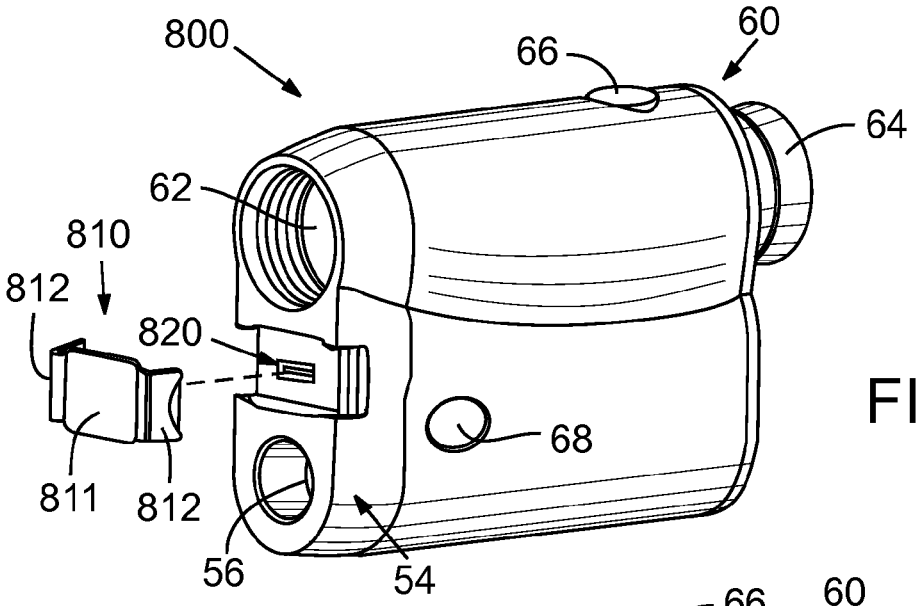
FIG. 8A is a frontal perspective view of a rangefinding device including a dongle, according to one embodiment.
Figure 8B:
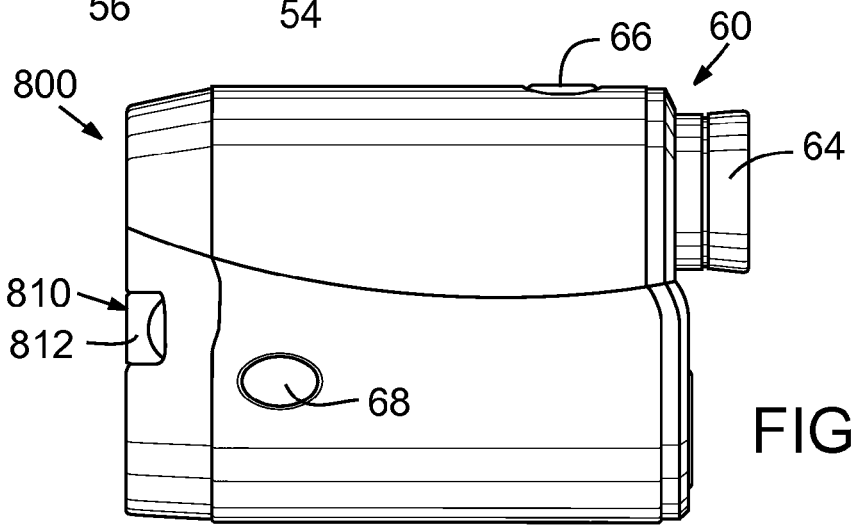
FIG. 8B is a frontal elevation of the rangefinding device of FIG. 8A.
Figure 8C:
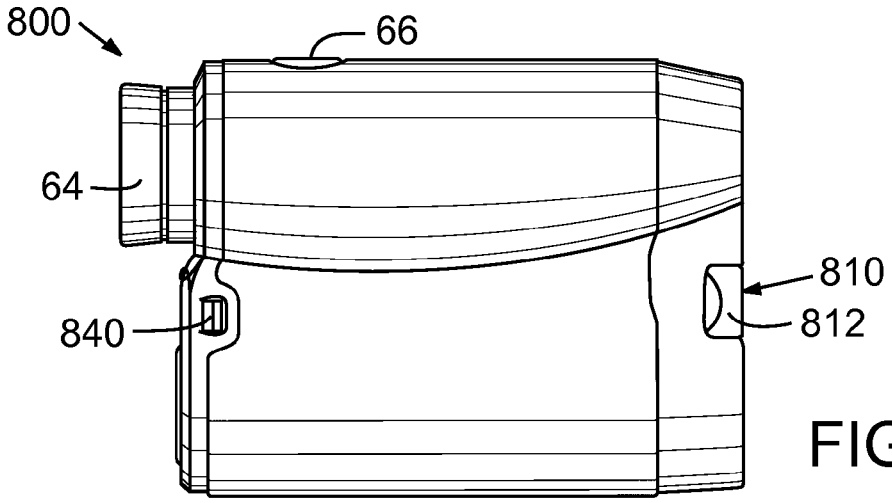
FIG. 8C is a rear elevation of the rangefinding device of FIG. 8A.
Figure 8D:
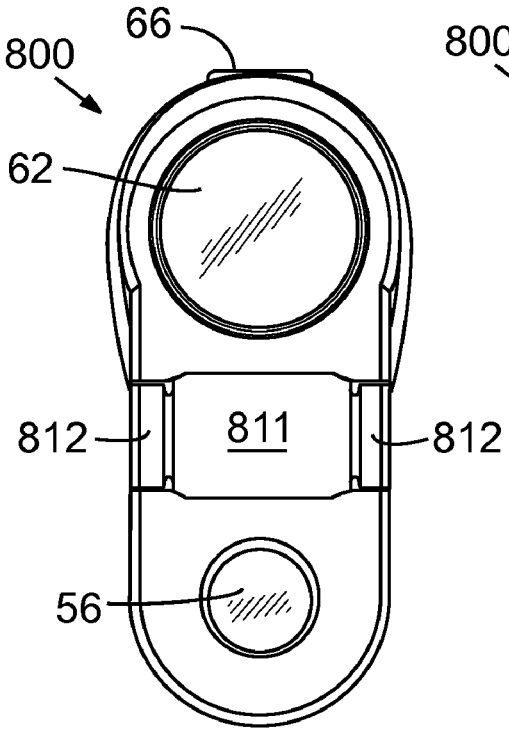
FIG. 8D is a left side elevation of the rangefinding device of FIG. 8A.
Figure 8E:
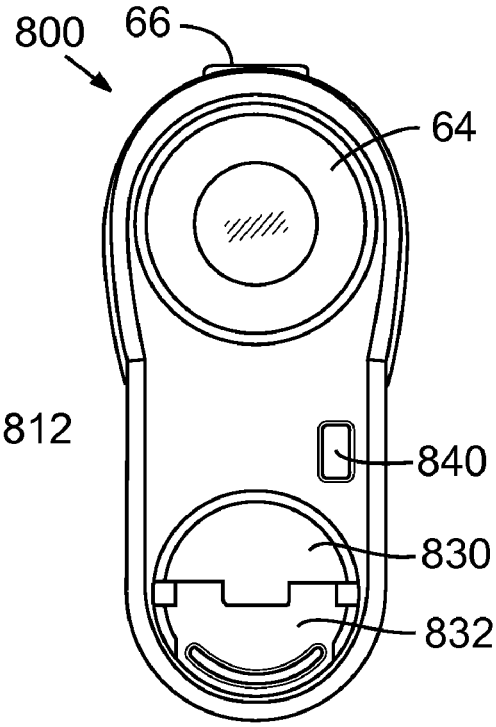
FIG. 8E is a right side elevation of the rangefinding device of FIG. 8A.
Figure 8F:
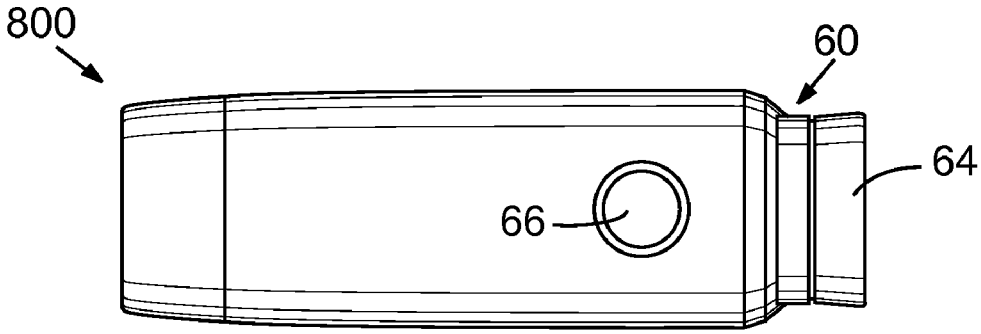
FIG. 8F is a top plan view of the rangefinding device of FIG. 8A.
Figure 8G:
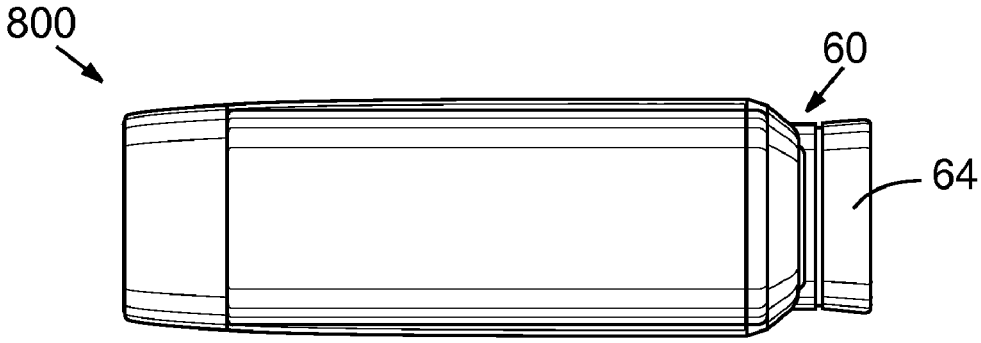
FIG. 8G is a bottom plan view of the rangefinding device of FIG. 8A.
Figure 8I:
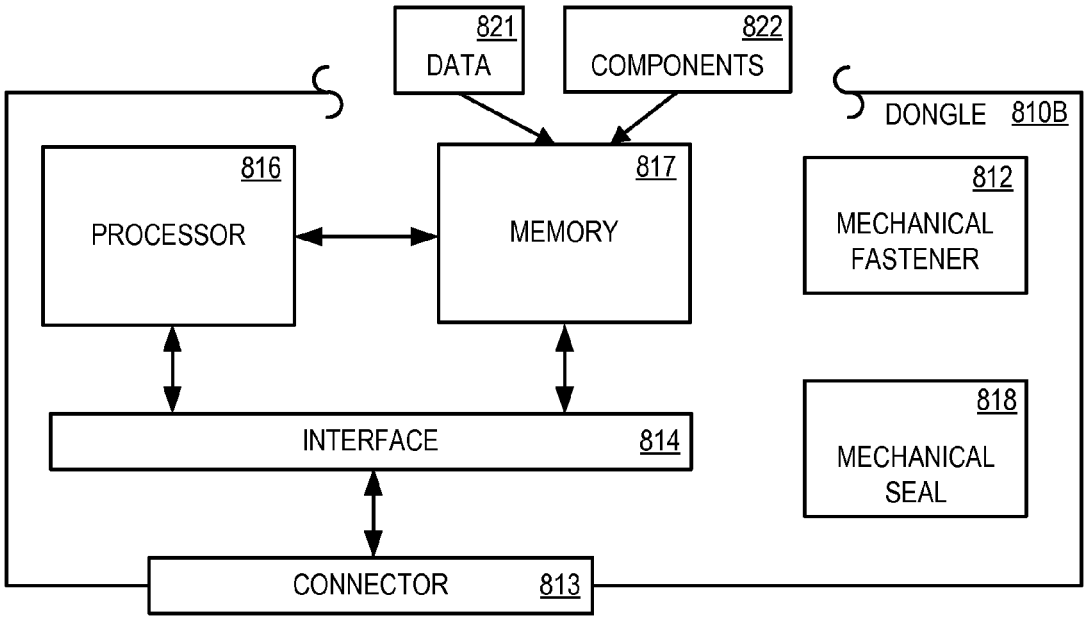
Figure 8J:
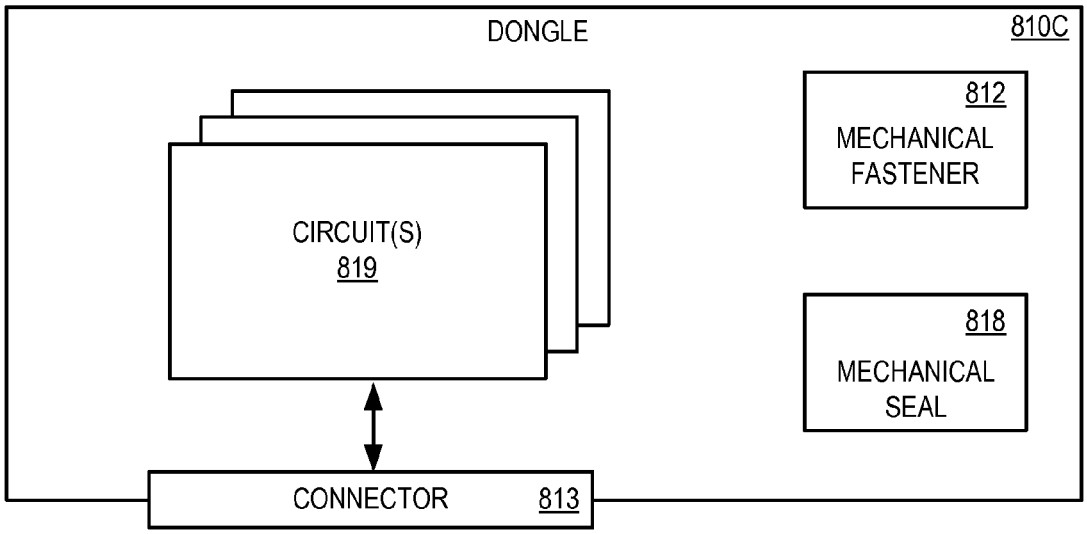

As shown in FIGS. 8A and 8D, the dongle 810 may include an alert portion 811 that notifies others whether the device 800 is measuring one or more conditions affecting a play. In addition, one or more of the 810, 810A, 810B, and 810C may include a light, such as a super-bright LED, to notify others whether one or more conditions affecting a play is being measured. Thus, the dongles 810, 810A, 810B, and 810C serve the dual purposes of enabling a set of sensors to function and allowing others, such as golf officials, to readily identify whether the device 800 is measuring one or more conditions affecting a play and presenting prohibited information to the player.

According to one embodiment, the device 800 includes a removable cap or cover 830 (FIG. 8E) to provide access to components housed within the device 800, such as a removable battery or memory. The cover 830 is removed by rotating a tab 832 away from cover 830, rotating or twisting the cover 830 (using the tab 832) to an unlocked position, and pulling the cover 830 away from the device 800. A strap mount or anchor 840 may also be provided for attaching a wrist strap or tether to the device 800. The strap may include a loop at one end, which can be threaded through strap mount 840. The other end of the strap may then be threaded through the loop and pulled tight to form a knot that attaches the strap to strap mount 840. Certain features and components shown in FIGS. 8A-8J may not be provided in certain embodiments and may be configured differently, such as the eyepiece 64, buttons 66 and 68, the cover 830, and the strap mount 840. For example, the eyepiece 64 and lenses 56 and 62 may be flush with the housing of the device 800. By way of another example, the device 800 may omit menu interface button 68 or include additional menu interface buttons. Further, the dongle 810 may be attached to the device 800 in another location or take another shape or size.

Figure 9A:
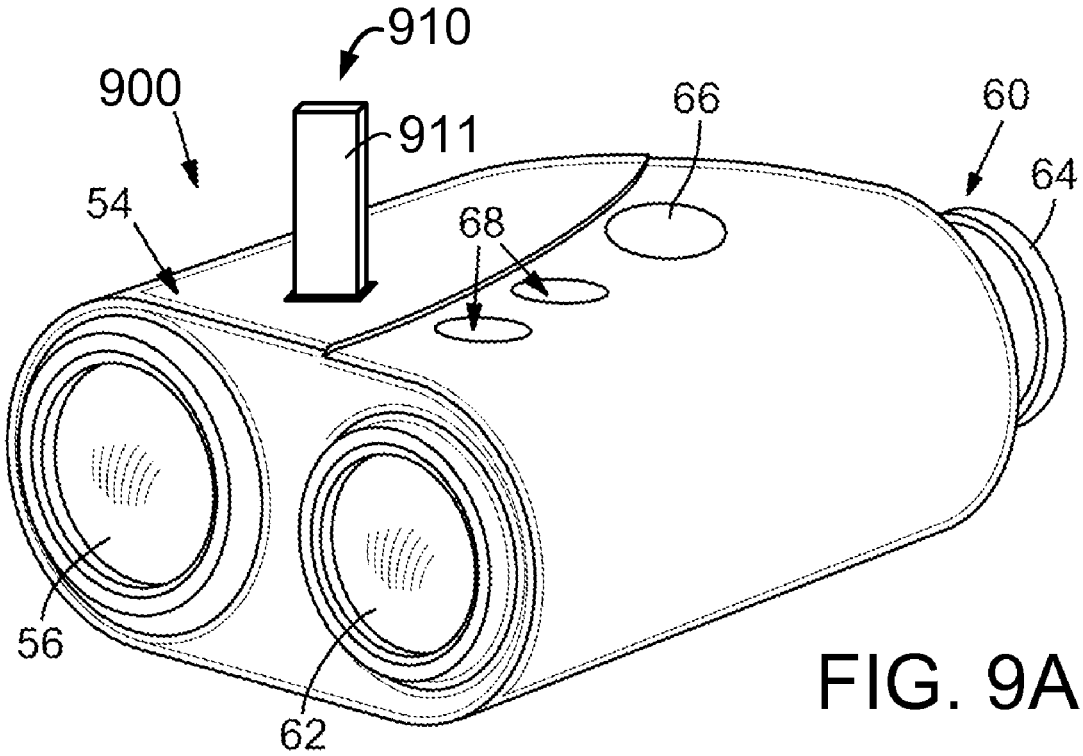
FIG. 9A is a perspective view of a rangefinding device including a dongle, according to another embodiment.

For example, as shown in FIGS. 8B and 8C, the dongle 810 mounts to the device 800 such that the dongle 810 is substantially flush with an external housing of the device 800. FIG. 9A illustrates a device 900 including a dongle 910 (having an alert portion 911 thereon) that protrudes from the housing of the device 900. The device 900 is a portable handheld rangefinder with special features and capabilities for use with golfing as described or substantially as described with respect to the device 800 above. The dongle 910 can be connected to the device 900 via a connector, such as a USB connector associated with the external device interface 450.

Figure 9B:
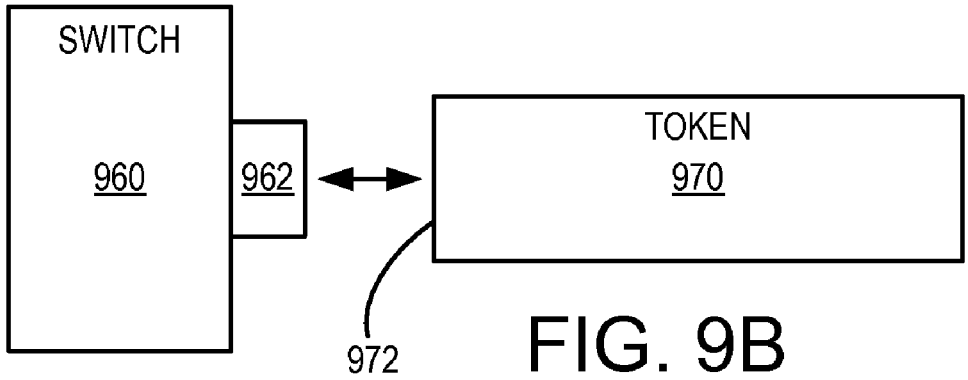
FIG. 9B is a functional block diagram of a compliance module comprising a switch, according to another embodiment.

According to another embodiment, the compliance module 710 comprises a switch housed within device 700 and is configured to provide the processor 410 with the indication of whether it is permissible to measure one or more conditions affecting a play. For example, as illustrated in FIG. 9B, the compliance module 710 comprises a switch 960. The switch 960 preferably includes an actuator 962 movable between at least two positions, such as an open-circuit position and a closed-circuit position, and may comprise any device used to selectively connect and disconnect a circuit, such as a push-button switch or surface mount switch. A token 970 may be provided having a switch activation portion 972 that activates the actuator 962 once the token 970 is attached to the device 700 or inserted into the device 700. According to one embodiment, inserting the token 970 into the device 700 enables one or more sensors (e.g., an inclinometer). In another embodiment, the opposite is true (i.e., inserting the token 970 disables one or more of the sensors). In still another embodiment, inserting the token 970 allows the device 700 to display (or prevents the device 700 from displaying) additional information that may affect the player's attempt to move a ball toward the target. The token 970 may take any shape or size. For example, the token 970 may look similar or identical to the dongle 810 or the dongle 910. Additionally, the token 970 may comprise a mechanical key, which activates the switch 960 (e.g., the switch 960 may comprise a keyswitch into which the mechanical key is inserted).

The token 970 may include an alert portion that notifies others whether the device 700 is measuring one or more conditions affecting a play. Thus, the token 970 may serve the dual purposes of activating the switch 960 and allowing others, such as golf officials, to readily identify whether the device 700 is presenting prohibited information to the player.

While the switch 960 may be housed within the device 700 and activated by the token 970, the switch 960 may be located elsewhere and be activated in other ways. For example, the switch 960 may be activated by buttons 66 or 68 or other externally accessible buttons. In addition, the switch 960 may be activated or deactivated by rotating the token 970 or similar indicator, such as a flag, from a resting position along the housing of the device 700 to a position perpendicular or substantially perpendicular to the housing. Further, the switch 960 may be activated or deactivated by sliding the token 970 or similar indicator from a position within the housing of the device 700 to a position external of the housing.

According to still another embodiment, the compliance module 710 comprises a receiver configured to provide the processor with an indication of whether it is permissible to measure one or more conditions affecting a play after the receiver receives a signal (i.e., the signal may enable or disable one or more sensors). For example, a golf course that has established a local rule permitting players to use rangefinders may install a wireless transmitting system that transmits wireless signals throughout the golf course. When a player using the device 700 is on the golf course, the receiver may receive the signal and instruct the processor whether it is permissible to measure one or more conditions affecting a play. If the receiver does not receive a signal, the device 700 may disable one or more of the sensors and display only the line-of-sight distance by default. Of course, various arrangements and combinations of transmitting and not transmitting wireless signals may be used to indicate whether it is permissible to measure one or more conditions affecting a play. For example, the wireless signal system may transmit a carrier wave that is modulated to carry information telling the receiver whether to enable or disable one or more of the sensors.

According to yet another embodiment, the compliance module 710 comprises GPS receiver 470 that provides the processor 410 with a geographic location of the device 700.

The memory 420 may store data concerning whether it is permissible to measure one or more conditions affecting a play based on a geographic location of the device 700. For example, the memory 420 may store geographic locations where only a line-of-sight distance may be displayed by device 700, such as geographic boundaries of golf courses that have established a local rule permitting players to use rangefinders that display only a line-of-sight distance. The processor 410 can compare the position data received from the GPS receiver 470 to the data concerning geographic locations on memory 420 to determine whether the device 700 can measure one or more conditions affecting a play and present the additional information to the player.

Figure 10:
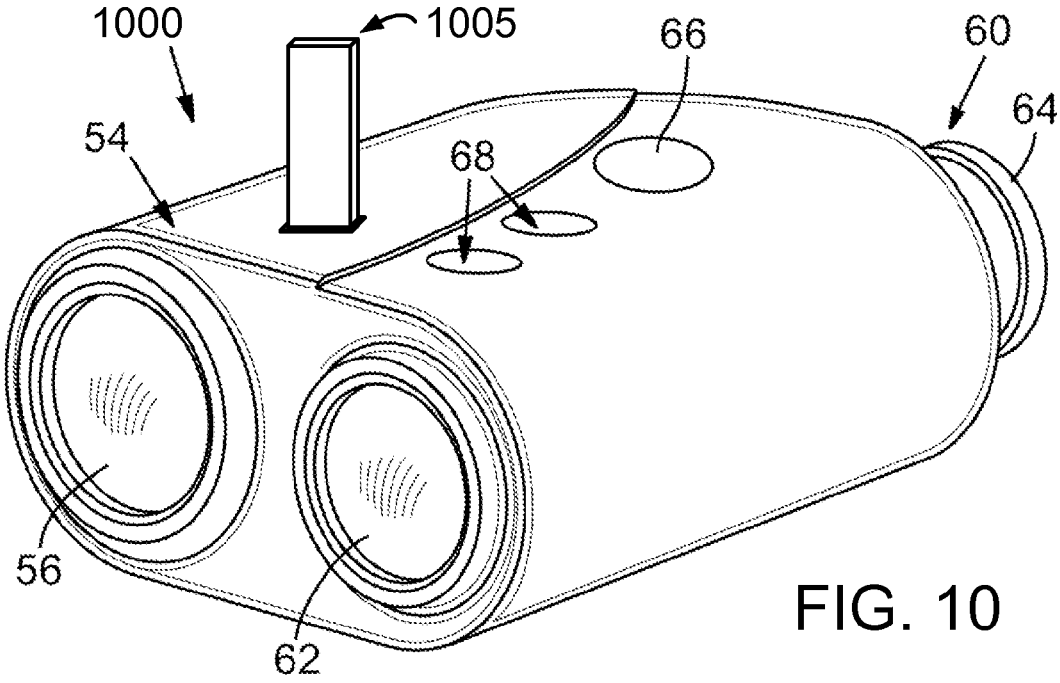
FIG. 10 is a perspective view of a rangefinding device including a dongle activated override module, according to one embodiment.

FIG. 10 illustrates a portable handheld rangefinder 1000 with special features and capabilities for use with golfing as described or substantially as described with respect to the device 50 above. The device 1000 is provided with an override module that permits the device 1000 to measure one or more conditions affecting a play even if the device 1000 is located within a geographic location that data stored in the memory 420 indicates is a location where only line-of-sight distance should be displayed. The override module may be useful for players who are not strictly abiding by the USGA rules, for example, for recreational play. The override module may comprise a dongle 1005 (e.g., similar to the dongle 810 or the dongle 910) that is connected to the device 1000 via a connector or a switch, as previously described, that is activated by inserting a token into the device 1000. Of course, the override module may be used with other embodiments as well.

Preferably, the devices 700, 800, 900, and 1000 are provided with external indicia, such as a bright color, to notify others whether one or more conditions affecting a play is being measured and whether information other than the line-of-sight distance is being presented to the player. For example, as previously described with reference to FIGS. 8A-8J, the dongle 810 includes an alert portion 811 that bears a visual indication, such as a color, light, or other visually perceptible item. The alert portion 811 may bear a visual indication in many manners, including, but not limited to, having paint, dye or stickers placed on the alert portion 811, being made from a colored material, preferably brightly colored (e.g., bright red, orange, yellow, or another bright color), and having a light such as a super-bright LED that is activated when the dongle 810 is connected to the device 800.

According to another embodiment, the external indicia may comprise a light. For example, portable handheld rangefinder 1100 illustrated in FIG. 11 (which is similar or identical to the device 50 described above), may include a light 1105, such as a super-bright LED, to notify others whether one or more conditions affecting a play is being measured and information other than the line-of-sight distance is being presented to the player. If the compliance module 710 is housed within the device 1100, the light 1105 lets others determine whether the user is viewing information other than the line-of-sight distance. The light 1105 may also be used in combination with an alert portion of a dongle or token.

In other embodiments, the indication may be electronic. For example, the indication may comprise a wireless signal transmitted by the device indicating whether the device is measuring or has measured one or more conditions affecting a play. By way of another example, the device may log data (e.g., in memory 420, memory 815, or both) indicating whether the device has measured one or more conditions affecting a play (or whether information other than the line-of-sight distance was presented to the player). The data can be accessed at a later point to determine whether the device was used to measure one or more conditions affecting a play during a round of golf (e.g., whether the device was used in compliance with tournament rules). For example, the device may present the data (e.g., via display 100) to a user, such as the player or golf official, after the user navigates to a data access menu using one or more buttons on the device. By way of another example, the device or dongle may be connected (via the external device interface 450) to an external device, such as a computer or terminal, so that the external device can access the data to determine whether one or more conditions affecting a play were measured. Thus, the external device may include hardware, software, firmware, or any combination thereof configured to access data stored in memory 420 or memory 815 (e.g., data indicating whether the device has measured one or more conditions affecting a play) to determine whether the rangefinding device was used in compliance with tournament rules, for example. The external device may also be configured to delete or reset the data after accessing the data. The log may include time specific data or location specific data (e.g., if the device includes a GPS receiver) so that it can be determined when or where the conditions were measured (e.g., during a practice session prior to the tournament instead of during the tournament).

In some embodiments, an indication may not be used at all. For example, a device equipped with a GPS receiver 470 may automatically display only the line-of-sight distance or display the line-of-sight distance in addition to the additional information based on the location of the device. In addition, embodiments that include an override module may also include a visual, electronic, or other sort of indication to let others know whether the device is measuring one or more conditions affecting a play and the user is viewing information other than the line-of-sight data. For example, the dongle 1005 used in connection with the device 1000 may include an alert portion and an indicator on or working in conjunction with the override module. Thus, the indicia, whether visual, electronic, or otherwise, may permit golf officials to readily determine whether a player is abiding by the USGA rules concerning rangefinders and other electronic distance measuring devices as previously described.

Figure 12:
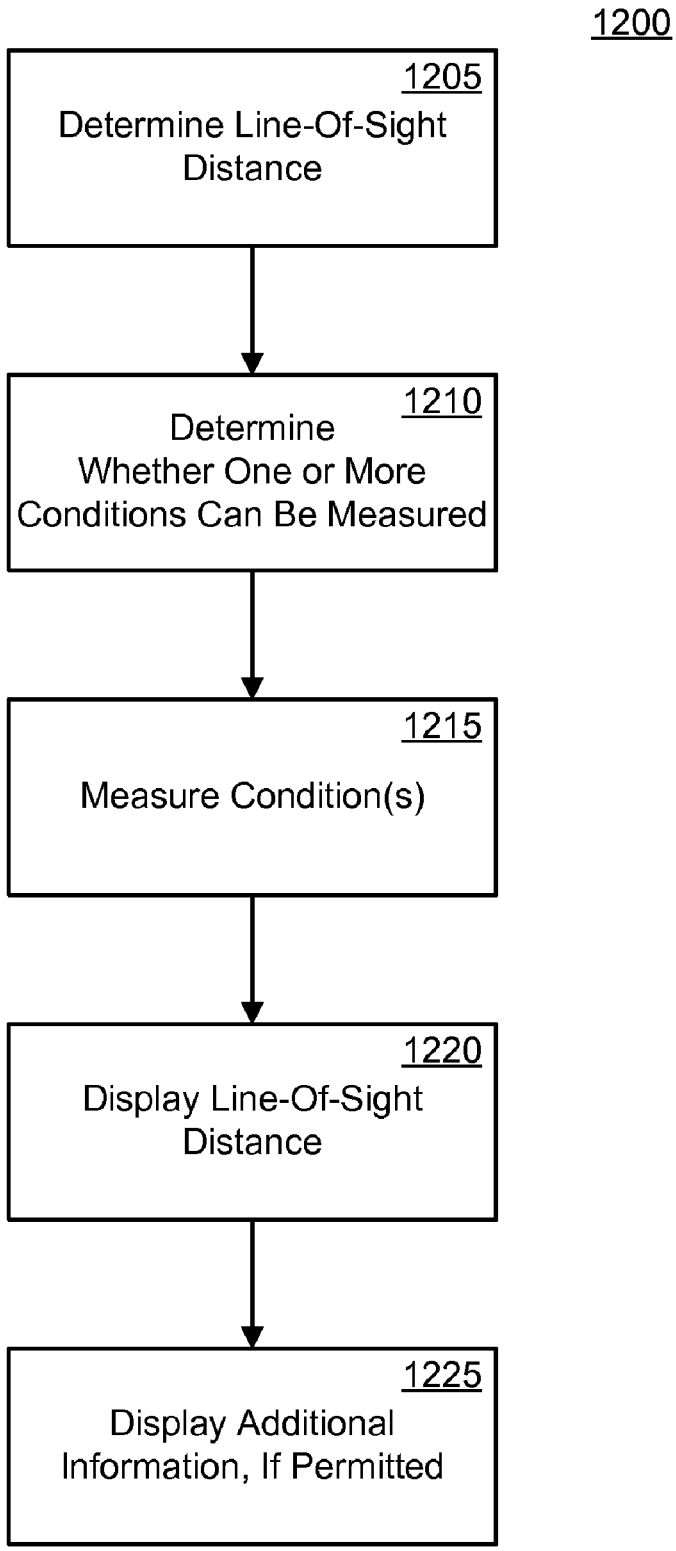
FIG. 12 is a flowchart of a method of using a rangefinding device, according to another embodiment.

Referring to FIG. 12, a method 1200 of using an electronic device (e.g., devices 700, 800, 900, and 1000) in aid of golfing is described. The device determines a line-of-sight distance between an electronic device and a target on a golf course at step 1205. The line-of-sight distance may be determined as previously described with reference to method 500, for example, using a rangefinder, the GPS receiver 470, or other suitable device and methodology.

At step 1210, the device determines whether it is permissible to measure one or more conditions affecting a play. According to one embodiment, the processor 410 checks a state of the compliance module 710 to determine whether it is permissible to measure one or more conditions affecting a play. For example, the processor 410 may check for permissions on a dongle (e.g., search for data) or check to see whether the dongle has been attached to the device to determine whether it is permissible to measure one or more conditions affecting a play. The processor 410 may also authenticate a dongle or a code stored on a dongle as previously described with reference to FIGS. 8A-8J. By way of another example, if the compliance module 710 comprises a switch, the processor 410 may check whether the switch is in an open-circuit or closed-circuit position to determine whether the switch has been activated (e.g., by the token). By way of yet another example, if the compliance module 710 comprises a receiver, the processor 410 may determine whether the receiver has received or is receiving a signal indicating whether it is permissible to measure one or more conditions affecting a play by checking the state of the receiver.

According to another embodiment, the processor 410 may determine a location of the device (e.g., from data provided by the GPS receiver 470) and check data within memory 420 to determine whether it is permissible to measure one or more conditions affecting a play based upon the current location of the device. According to yet another embodiment, the processor 410 may check data stored in memory 420 to determine whether it is permissible to measure one or more conditions affecting a play. For example, data indicating whether it is permissible to measure one or more conditions affecting a play may be received wirelessly by a golf course's wireless network or via a wired connection, such as when a player checks in for a golf tournament, and stored in memory 420. By way of another example, a receiver may store data in memory 420 indicating whether the receiver has received or is receiving a signal probative of whether it is permissible to measure one or more conditions affecting a play.

If the device determines that it is permissible to measure one or more conditions affecting a play, the device measures one or more conditions affecting a player's attempt to move a ball toward a target at step 1215. For example, as previously described with reference to the device 50, a set of sensors, such as one or more of an inclinometer, a temperature sensor, a humidity sensor, an altimeter, an anemometer, a compass, and a barometer, may be used to measure variables the processor 410 can use to determine or calculate the density of air or other parameters affecting a golf ball's flight. Thus, the device may enable one or more of the sensors to measure one or more conditions affecting a play at step 1215.

According to another embodiment, the device measures one or more conditions affecting a play and then determines whether it is permissible to present additional information to the player based upon the one or more measured conditions (e.g., after step 1215 or in place of steps 1210 and 1215). The device may determine whether it is permissible to present additional information to the player based upon the one or more measured conditions in a similar manner as that described in step 1210 (e.g., checking a state of the compliance module 710).

At step 1220, the device presents the line-of-sight distance to the player (e.g., via the display 100). If it is permissible to display the additional information to the player, the device presents the additional information to the player (e.g., via the display 100) at step 1225. The additional information may include, but is not limited to, true distance, adjusted distance, equivalent horizontal range, a suggested club, a suggested swing speed, ball type, hitter ability, hitting distance, handicap, temperature, angle of inclination, ground slope, course layout, humidity, altitude, wind speed, compass direction, barometric pressure, air density, and other conditions and parameters. Thus, the additional information may be calculated or determined by the processor 410 based on the one or more measured conditions as previously described with reference to method 500. The additional information may also include data input by a user or data input into a device from another source, such as a computer.

Figure 11:
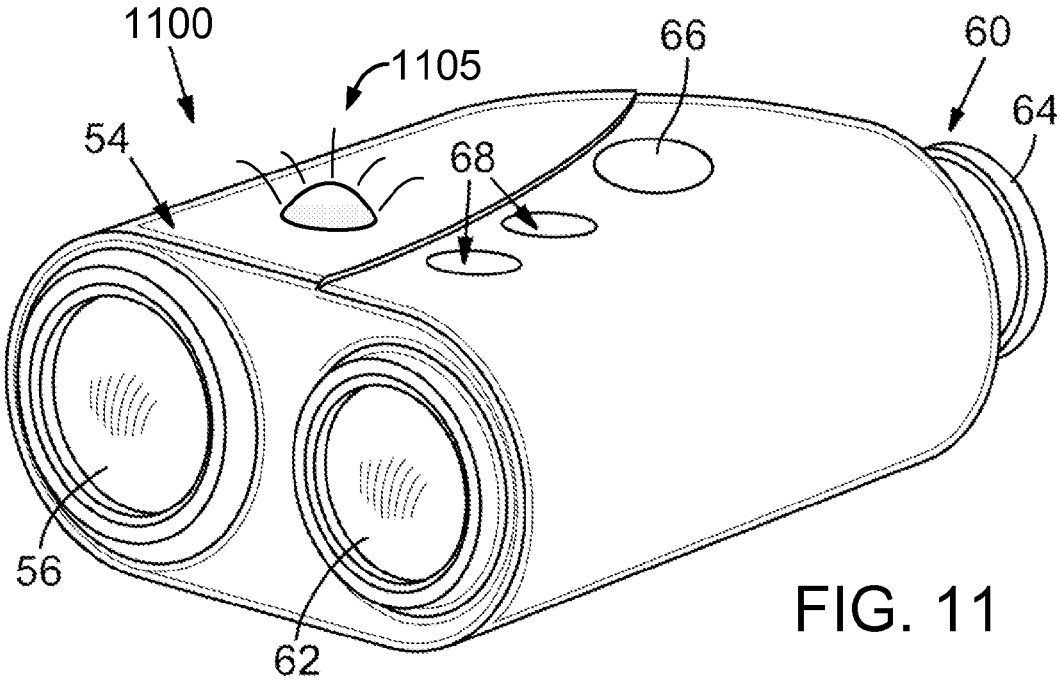
FIG. 11 is a perspective view of a rangefinding device including a light to notify others whether a condition affecting a play is being measured, according to one embodiment.

The device may also notify others whether the additional information is being presented to the player, such as by turning on or flashing the light 1105 of FIG. 11 or by broadcasting a signal or data.

Modular Rangefinding System

Figure 13:
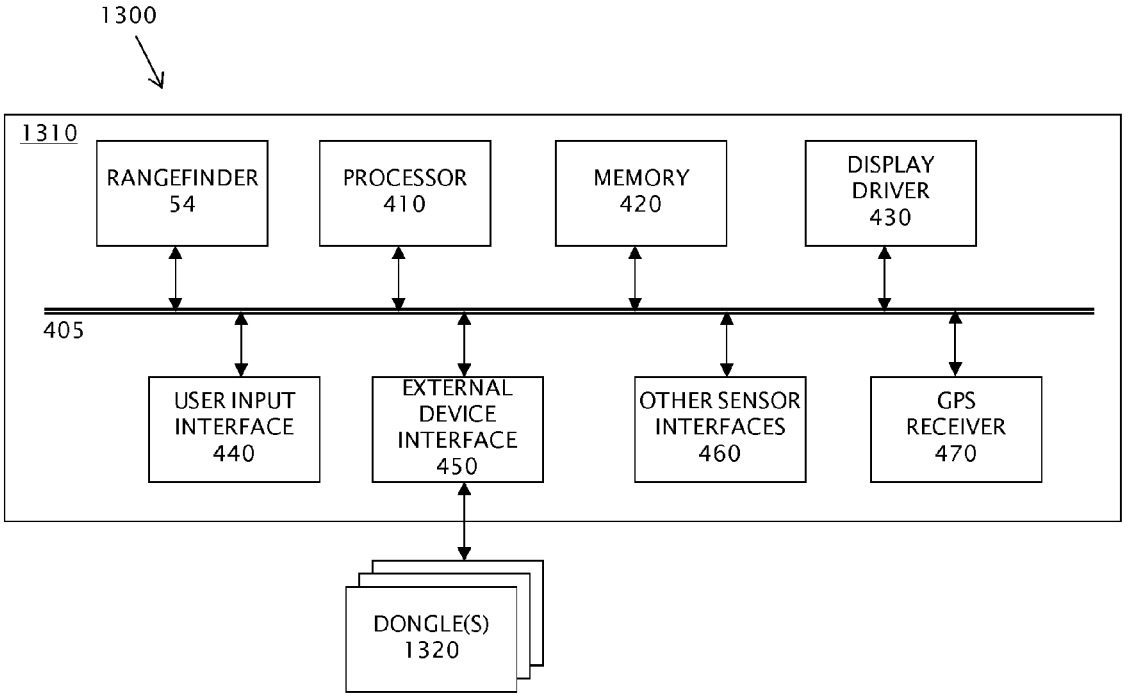
FIG. 13 is a functional block diagram of a modular rangefinding system, according to one embodiment.

FIG. 13 is a functional block diagram of a modular rangefinding system 1300, according to one embodiment. The system 1300 preferably comprises a portable handheld rangefinder 1310 substantially as described with respect to the device 50 above having one or more keys or dongles 1320 detachably coupled thereto. The dongles 1320 provide unique functionality to the handheld rangefinder 1310. For example, attaching a TGR™ dongle 1320D (FIG. 14) to the handheld rangefinder 1310 may provide golf specific functionality to the handheld rangefinder 1310, such as calculating a true distance (e.g., based on data from an electronic inclinometer) that the golfer may use to play an inclined shot. Attaching a different one of the dongles (e.g., TBR® dongle 1320A of FIG. 14) to the handheld rangefinder may provide hunting functionality, such as calculating an equivalent horizontal distance (e.g., based on data from an electronic inclinometer) that the hunter may use for precise shooting on an incline. If one of the dongles 1320 is not coupled to the handheld rangefinder 1310, the handheld rangefinder 1310 may run in a restricted mode, such as measuring a line-of-sight distance (e.g., via the rangefinder 54) without calculating a true distance (e.g., for use by a golfer) or equivalent horizontal distance (e.g., for use by a hunter). Thus, when the handheld rangefinder 1310 is running in a restricted mode, the user is not provided additional information that may help the user make a better shot (e.g., in a golfing or hunting context).

Providing unique functionality to a handheld rangefinder using one or more dongles may allow a standard handheld rangefinder (or limited number of standard handheld rangefinders) to be designed, built, and distributed, which may help reduce overall design time and costs and lower inventory levels. In other words, instead of designing, building, and distributing several handheld rangefinders that each provide a specific function (e.g., a golf rangefinder, a hunting rangefinder, and a tactical/sniper rangefinder), a standard handheld rangefinder platform (or limited number of standard handheld rangefinders) may be designed, built, and distributed along with one or more dongles that each provides or unlocks unique functionality.

One of the dongles (e.g., a TBR® dongle 1320A) enables TRUE BALLISTIC RANGE® (TBR) functionality, which may activate methods for determining an equivalent horizontal range that may be used by the hunter or shooter to make a holdover or elevation adjustment for accurately aiming a projectile weapon at an elevated or depressed target. For example, a shooter at a vantage point may determine a line-of-sight range to the target (e.g., using the rangefinder 54) and an angle of inclination of the inclined line-of-sight to the target (e.g., using an electronic inclinometer). After the line-of-sight range and the angle of inclination of the inclined line-of-sight have been determined, a trajectory parameter is calculated or otherwise determined at the line-of-sight range for a preselected projectile shot from the vantage point toward the target. The trajectory parameter at the line-of-sight range may comprise one or more of a ballistic path height (e.g., arrow path or bullet path), ballistic drop relative to line of initial trajectory (e.g., a bore line), observed ballistic drop perpendicular to the line-of-sight, velocity, energy, and momentum. After the trajectory parameter has been calculated, the equivalent horizontal range may be calculated based on the trajectory parameter and possibly other parameters. For example, the equivalent horizontal range may be calculated as the range at which the trajectory parameter would occur if shooting the projectile in a level-fire condition from the vantage point toward a theoretical target in a common horizontal plane with the vantage point, wherein the horizontal plane coincides with the level fire line-of-sight.

The calculation of trajectory parameter, the calculation of equivalent horizontal range, or both, may also be based on a ballistic coefficient of the projectile and one or more shooting conditions. The ballistic coefficient may be a function of the mass, diameter, and drag coefficient of the projectile. The shooting conditions may include projectile weapon conditions, such as an initial velocity of the projectile, meteorological conditions, such as temperature, relative humidity, and barometric pressure, and geospatial shooting conditions, such as the compass heading of the line-of-sight to the target and the geographic location of the vantage point (including latitude, longitude, altitude, or all three). The ballistic coefficient and shooting conditions may be specified by the shooter or automatically determined by the handheld rangefinder 1310 (e.g., measured by sensors in communication with the handheld rangefinder 1310 or accessed from a memory associated with the handheld rangefinder 1310).

The trajectory parameter, the equivalent horizontal range, or both, may be presented to the shooter via the display 100 and the display driver 430 in the form of aiming information, such as a minutes of angle (MOA) adjustment (e.g., the MOA of elevation to adjust a riflescope for precise zero), a holdover adjustment (e.g., inches or centimeters to holdover or hold under the aim point on the target), and a ballistic aiming system (BAS) adjustment (e.g., the equivalent horizontal range at which the shooter should aim assuming the shooter was shooting under level-fire conditions). Thus, the shooter may make a holdover or holdunder adjustment based on the aiming information when aiming the projectile weapon or may adjust an elevation adjustment mechanism of a riflescope or other aiming device based on the aiming information.

One or more program modules, such as a set of instructions for implementing the TBR functionality, may be stored in the memory 420 of the handheld rangefinder 1310, a memory of the TBR dongle, or both. Data associated with the TBR functionality, may also be stored in the memory 420 of the handheld rangefinder 1310, a memory of the TBR dongle, or both. The data may include ballistic coefficients for various bullets and arrows or groups thereof. For example, ballistic groups may be provided for bullets and arrows that effectively normalize groups of bullets and arrows having similar characteristics, such as three ballistic groups for arrows and seven ballistic groups for bullets. A different dongle may be provided for each ballistic group. The data may also include ballistic data tables including predicted trajectory parameters for known shooting conditions over a range of angles and equivalent horizontal range data (under level-fire conditions) over a range of trajectory parameters. One or more sensors, such as an inclinometer, compass, temperature sensor, barometer/altimeter, and relative humidity sensor, may be provided with the handheld rangefinder 1310 to facilitate accurate ballistics calculations. The one or more sensors may be integrated within the handheld rangefinder 1310, provided on the TBR dongle, or both. U.S. Pat. No. 7,654,029 describes additional details of determining equivalent horizontal range and other methods and systems for compensating for ballistic drop.

Another one of the dongles (e.g., an ABR dongle 1320B) enables archery specific ballistic range (ABR) functionality, which activates methods for providing aiming information matched to the performance of a bow (or group of bows) and arrows (or group of arrows) used with the bow. The ABR dongle may provide the same or different archery specific functionality as the TBR dongle. For example, the ABR dongle may provide additional bow groups (e.g., the TBR dongle may allow the shooter to select a group from three bow groups while the ABR dongle may allow a selection to be made from more than three bow groups). Additionally, the ABR dongle may allow the shooter to select the specific bow, arrow, or both, that the shooter is using (e.g., the ABR dongle may include or activate data customized for most or all of the commercially available bows and arrows). Further, the ABR dongle may include or activate customized data, such as customized ballistic coefficients and shooting conditions entered by the shooter or provided by a manufacturer of the bow, the arrow, or both. Thus, the shooter may use the ABR dongle when hunting or shooting with a bow. Because data specific to certain bows and arrows may take additional memory or require additional processing power, providing the specific data on the ABR dongle may simplify the design and lower the cost of the handheld rangefinder 1310. Further, if data updates become available (e.g., data tailored to new bows or arrows), the shooter may obtain the updated ABR dongle without upgrading the handheld rangefinder 1310.

Yet another one of the dongles (e.g., a tactical dongle 1320C) enables tactical specific ballistic range functionality, which activates methods for providing aiming information matched to the performance of specific cartridges, such as 5.56 mm (.223 Remington) cartridges or 7.62 mm (.308 Winchester) cartridges, or both, and in some embodiments, for specific rifles or other firearms. The tactical dongle preferably includes or enables access to customized data, such as customized ballistic coefficients and shooting conditions, for specific cartridges and firearms. Thus, the shooter may use the tactical dongle when hunting or shooting with a particular cartridge or rifle.

Still another one of the dongles (e.g., a TGR™ dongle 1320D) enables TRUE GOLF RANGE™ (TGR™) functionality, which activates methods for providing information to help a golfer or user play a shot. For example, the information may include an equivalent horizontal range, a true distance, an adjusted distance, a suggested club, a suggested swing speed, a ball type, a hitter ability, a hitting distance, a handicap, a temperature, an angle of inclination, a ground slope, a course layout, a humidity, altitude, wind speed, compass direction, barometric pressure, air density, and other conditions and parameters. The information may be calculated or determined by the processor 410 based on the one or more measured conditions as previously described (e.g., with reference to FIGS. 5, 8A-8J, and 12). The conditions may be measured by one or more sensors, such as one or more of an inclinometer, a temperature sensor, a humidity sensor, an altimeter, an anemometer, a compass, and a barometer. If the TGR™ dongle is not coupled to the handheld rangefinder 1310, the handheld rangefinder 1310 will not provide information to help the golfer play a shot and may instead present a line-of-sight distance to the golfer. According to one embodiment, the dongle 1320D (not the handheld rangefinder 1310) includes one or more sensors to measure, for example, wind speed, gradient, or temperature, and includes instructions to determine information that may help a golfer play a shot (e.g., determine an adjusted distance or recommend one or more of a club, swing speed, or ball type). Thus, when the TGR™ dongle is not coupled to the handheld rangefinder 1310, the handheld rangefinder 1310 may comply with local rules of golf (e.g., USGA Rule 14-3, Note and Decision 14-3/0.5), which permit the use of a device that measures distance only, because the handheld rangefinder 1310 would not have the capability of gauging or measuring other conditions that might affect play (e.g., wind speed, gradient, and temperature) or the capability to assist in calculating the effective distance between two points (e.g., the distance after considering gradient, wind speed, wind direction, temperature, and other environmental factors) or assist the player by recommending, for example, a club to use unless the dongle 1320D including one or more sensors or instructions is attached to the handheld rangefinder 1310.

Yet another one of the dongles (e.g., a base dongle 1320E) enables base unit functionality, which activates methods for measuring and presenting to a user a line-of-sight distance between the handheld rangefinder 1310 and an object. The base unit functionality may allow the handheld rangefinder 1310 to display (e.g., via display driver 430 and display 100 or 200) the line-of-sight data and other permitted data without displaying additional information that might assist a player in making a stroke or play, such as displaying an effective distance between two points (e.g., a distance after considering gradient, wind speed, wind direction, temperature, or other environmental factors) or recommending a club selection, a type of shot to be played (e.g., a punch shot or a pitch and run), or a recommended line of putt. The other permitted data may include, for example, information on advice-related matters that was produced prior to the start of a player's round (e.g., an electronic yardage book or swing tips), playing information from previous rounds (e.g., driving distances and individual club yardages), and information related to a competition being played (e.g., the leader board or projected cut). According to one embodiment, the handheld rangefinder 1310 may not function or may function in a limited mode unless the base unit dongle (or another dongle) is coupled to the handheld rangefinder 1310. According to another embodiment, the base unit dongle may comprise a blank key that attaches to the handheld rangefinder 1310. Thus, the blank key may help prevent water and dirt from entering the housing of the handheld rangefinder 1310.

Other dongles 1320 may provide one or more of the functionalities described above or other functionalities. For example, a forestry dongle may be provided that calculates or determines a height of a tree or how much lumber a tree may yield. The forestry dongle may calculate or determine the height of a tree by prompting the user to take one or more measurements and calculating the height of the tree based on those measurements. For example, the device may prompt the user to aim the device at the base of a tree and depress the range button. After the user depresses the range button, the device can determine a line-of-sight distance to the base of the tree and an angle of inclination/declination to the base of the tree (e.g., based on data received from an inclinometer). The device may then prompt the user to aim the device at the top of the tree and depress the range button again. After the user depresses the range button, the device can determine a line-of-sight distance to the top of the tree and an angle of inclination/declination to the top of the tree (e.g., based on data received from an inclinometer). Based on those measurements, the device may determine or calculate the height of the tree (e.g., using geometry) and display the height.

By way of another example, a speed-determining dongle may be provided that calculates the speed of a moving object. The speed-determining dongle may calculate or determine the speed of a moving object by taking multiple line-of-sight distance measurements and using Doppler effect techniques to determine or calculate whether the object is moving towards or away from the device and, if so, the speed at which the object is moving towards or away from the device. The speed-determining dongle may be used by fans of auto racing sports, for example.

Figure 14:
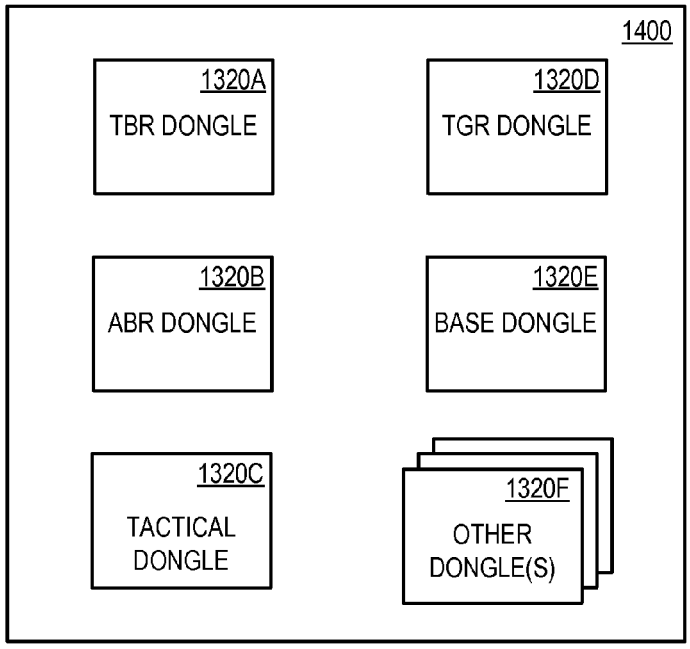
FIG. 14 shows a schematic diagram of a kit including a plurality of dongles.

The dongles 1320 may be provided in a kit 1400 as shown in FIG. 14 or provided individually. The kit 1400 may include a TBR dongle 1320A, an ABR dongle 1320B, a tactical dongle 1320C, a TGR™ dongle 1320D, a base dongle 1320E, and possibly one or more other dongles 1320F.

The above described functionality can be implemented in any number of ways. According to one embodiment, one or more program modules, such as a set of instructions for implementing one or more of the functionalities described above, and data (e.g., look-up tables) associated with the functionality are stored in memory 420 and one or more sensors associated with the functionality are integrated within the handheld rangefinder 1310 (e.g., located within a housing of the handheld rangefinder 1310). Thus, the handheld rangefinder 1310 may include the components and modules to implement the functionalities described above, but the functionalities are not accessible or usable unless one of the dongles 1320 is coupled to the handheld rangefinder 1310 (e.g., the TBR dongle 1320A may have a TBR code installed thereon to activate TBR functionality, the ABR dongle 1320B may have a ABR code installed thereon to activate ABR functionality, the tactical dongle 1320C may have a tactical code installed thereon to activate tactical functionality, the TGR™ dongle 1320D may have a TGR code installed thereon to activate TGR functionality, and so forth). Accordingly, one or more of the functionalities described above may be enabled by attaching one or more of the dongles 1320 to the handheld rangefinder 1310.

According to another embodiment, one or more program modules (to implement the functionalities described above), data associated with the functionality, and one or more sensors associated with the functionality are distributed in the rangefinding system 1300. For example, each dongle may include the program modules, data, and sensors to implement one or more of the functionalities described above. By way of another example, the program modules, data, and sensors may be distributed between the dongle and the handheld rangefinder 1310 (e.g., one or more of the sensors may be installed within the handheld rangefinder 1310 and the program modules and data may be stored on the dongle or vice versa).

Including the program modules, data, and sensors on or within the handheld rangefinder 1310 may allow the sensors to be aligned and calibrated by the manufacturer. Thus, the user can utilize the additional functionality after coupling one of the dongles to the handheld rangefinder 1310 without aligning the sensors or calibrating the handheld rangefinder 1310. On the other hand, including one or more of the program modules, data, and sensors on a dongle may simplify the design and lower the cost of the handheld rangefinder 1310 by allowing a smaller memory, slower processor, and fewer components to be used in the handheld rangefinder 1310. Further, including one or more of the program modules, data, and sensors on a dongle may allow the user to purchase another dongle having new or additional functionalities thereon without upgrading the handheld rangefinder 1310. Further still, including one or more of the program modules, data, and sensors on a dongle may help the handheld rangefinder 1310 comply with local rules of golf (e.g., USGA Rule 14-3, Note and Decision 14-3/0.5), which permit the use of a device that measures distance only, because the handheld rangefinder 1310 would not have the capability of gauging or measuring other conditions that might affect play (e.g., wind speed, gradient, and temperature) or the capability to assist in calculating the effective distance between two points (e.g., the distance after considering gradient, wind speed, wind direction, temperature, and other environmental factors) or assist the player by recommending, for example, a club to use unless a dongle including one or more of the program modules, data, or sensors is attached to the handheld rangefinder 1310.

Figure 15:
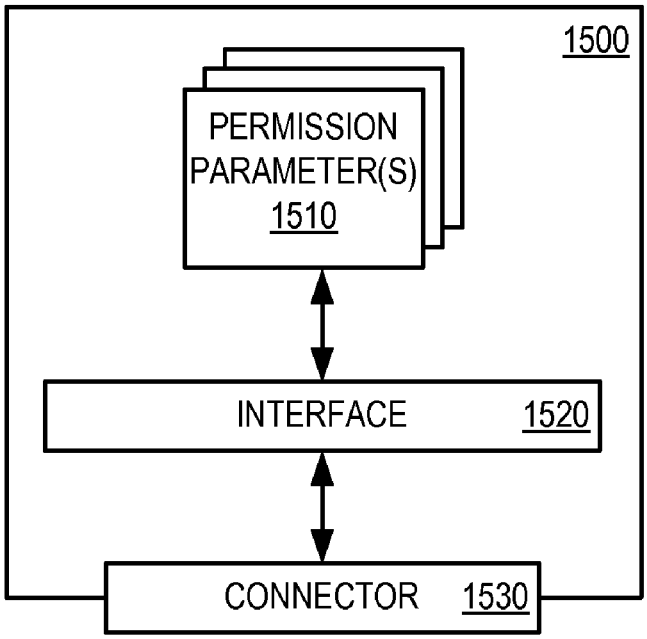
FIGS. 15 and 16 are functional block diagrams of dongles, according to various embodiments.

The dongles may take many configurations. FIG. 15 is a functional block diagram of a dongle 1500, according to one embodiment. The dongle 1500 comprises one or more permission parameters 1510, which selectively configure the handheld rangefinder 1310 to provide one or more of the functionalities described above, and an interface 1520 and a connector 1530, which are configured to communicatively connect the dongle 1500 to the handheld rangefinder 1310 via the external device interface 450. The connector 1530 is preferably configured to mate with a corresponding connector on the handheld rangefinder 1310. The connector 1530, the connector on the handheld rangefinder 1310, or both, may comprise any suitable electrical connector that communicatively couples the dongle 1500 to the handheld rangefinder 1310, such as a USB connector, D-subminiature connector, edge connector, friction lock header, or other plug-and-socket or non-plug-and-socket connector. The interface 1520 facilitates data input and output through the connector 1530 when the dongle 1500 is connected to the handheld rangefinder 1310. Thus, the interface 1520, the external device interface 450, or both, may include hardware, software, firmware, or any combination thereof that implements one or more protocols, such as stacked protocols, along with corresponding layers, so that the interface can function as a serial port (e.g., RS232), a USB port, or an IR interface. Of course, the interface 1520, the external device interface 450, or both may also support various wired, wireless, optical, and other communication standards.

The dongle 1500 preferably includes hardware, software, firmware, or a combination thereof bearing the one or more permission parameters 1510. According to one embodiment, the one or more permission parameters 1510 include data stored on a memory of the dongle 1500, such as a TGR code (e.g., data, such as text or a numeric value, indicating that the inclinometer and TGR algorithm may be activated). For example, after the user pushes a ranging button, the device may interrogate the dongle 1500 to determine whether to activate methods for providing information to help the user play a shot (e.g., determine an equivalent horizontal range, true distance, or an adjusted distance based on the angle of inclination, the altitude, temperature, and hitting strength of the user). The handheld rangefinder 1310 may be configured to authenticate the dongle 1500 (e.g., as described with reference to FIGS. 8A-8J) or search for encrypted or unencrypted data or a module, such as a program module that implements one or more of the functionalities described above, stored on the dongle 1500. Configuring handheld rangefinder 1310 to authenticate the dongle 1500 or to search for data or a module stored on the dongle 1500 may allow tighter control over which functionalities the user accesses (e.g., the user cannot simply plug a USB flash drive into the handheld rangefinder 1310 to enable one or more of the functionalities). According to another embodiment, the one or more permission parameters 1510 include a specific circuit on or within the dongle 1500, which may include one or more sensors associated with the functionalities the dongle is configured to enable. Thus, the handheld rangefinder 1310 may be configured to identify a specific circuit within the dongle to determine which functionalities to enable. According to still another embodiment, the dongle 1500 does not include any permission parameters and the handheld rangefinder 1310 is configured to enable one or more of the sensors (e.g., sensors internal to the handheld rangefinder) after determining that a device, such as dongle 1500, has been attached to the handheld rangefinder 1310 (e.g., by monitoring status bits that report the attachment or removal of a USB device) without searching for data or a module stored on the dongle or a circuit included with the dongle.

The permission parameters 1510 may enable or disable one or more of the sensors (e.g., disabling the sensors until needed may conserve power and extend battery life), may enable or disable one or more of the modules that provide one or more of the functionalities described above, may enable or disable access to the data associated with the functionalities, or may allow or prevent the presentation to the user of the information provided by the additional functionality (e.g., an equivalent horizontal range may be calculated using data from a sensor, but prevented from being presented to the user).

Figure 16:
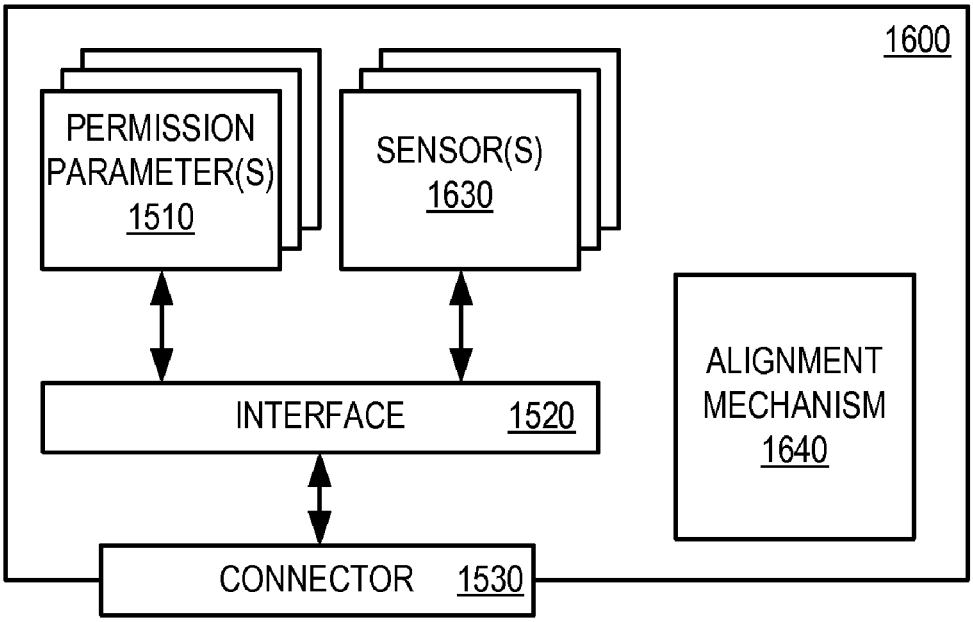

FIG. 16 is a functional block diagram of a dongle 1600, according to another embodiment. The dongle 1600 includes one or more sensors 1630 associated with the one or more functionalities provided by the dongle along with the permission parameters 1510, interface 1520, and connector 1530, which may comprise any of the permission parameters, interfaces, and connectors described with reference to FIG. 15. Thus, the permission parameters 1510 may comprise one or more program modules that implement one or more of the functionalities described above and data (e.g., look-up tables) associated with the functionality stored in a memory of the dongle 1600.

One or more of the sensors may need to be aligned, calibrated, or both after coupling (or while coupling) the dongle 1600 to the handheld rangefinder 1310. For example, an inclinometer sensor may need to be aligned with rangefinder 54 so that the inclinometer provides accurate angle of inclination data with respect to the inclined line-of-sight distance measured by the rangefinder 54. According to one embodiment, an alignment mechanism 1640 is provided to align the dongle 1600 (and therefore the one or more sensors 1630) with the handheld rangefinder 1310. The alignment mechanism 1640 may comprise the connector 1530 (e.g., the connector itself or a mechanical fastener associated with the connector), a separate mechanism (e.g., one or more fingers, tongues, or tabs that engage recesses or grooves of the handheld rangefinder 1310 or a mechanical fastener similar or identical to the mechanical fastener 812 described with reference to FIGS. 8A-8J), or an adjustable alignment mechanism that is operable to adjust a relative position of the dongle 1600 with respect to the handheld rangefinder 1310. The adjustable alignment mechanism may comprise one or more set screws (e.g., a set screw to adjust a position of the dongle 1600 along one or more of an x-axis, y-axis, or z-axis) extending between the dongle 1600 and the handheld rangefinder 1310. A pitch of a set screw thread may be selected to provide small or fine adjustments along an axis of the set screw. To align one or more of the sensors on the dongle 1600 with the handheld rangefinder 1310, one or more of the set screws may be rotated about an axis of rotation. For example, the handheld rangefinder 1310 may be placed on a level surface and a relative position of the dongle 1600 with respect to the handheld rangefinder 1310 may be adjusted (e.g., via a set screw) until the handheld rangefinder 1310 provides an indication (e.g., via display 100 or an externally mounted indicator, such as an LED) that the dongle 1600 is properly aligned (e.g., the inclination data received from the inclinometer indicates that there is substantially no angle of inclination with respect to the rangefinder 54).

According to another embodiment, instead of or in addition to providing the alignment mechanism 1640 and aligning the dongle 1600 with respect to the handheld rangefinder 1310, one or more of the sensors 1630 are calibrated after the dongle 1600 is coupled to the handheld rangefinder 1310. For example, the handheld rangefinder 1310 may be placed on a level surface, an angle of inclination may be measured by the inclinometer, and the measured angle of inclination may be stored as an offset, which may be added to or subtracted from an angle of inclination measured by the inclinometer during normal use. The calibration may be repeated for other orientations of the handheld rangefinder 1310 (e.g., the handheld rangefinder 1310 may be calibrated over three iterations so that three orthogonal sides of the handheld rangefinder 1310 may be placed on a level surface).

According to one embodiment, the dongles 1320, 1500, or 1600 are mounted to the handheld rangefinder 1310 such that the dongles are substantially flush with an external housing of the handheld rangefinder 1310 (e.g., the dongles may be similar or identical to dongle 810 described with reference to FIGS. 8A-8J). According to another embodiment, dongles 1320, 1500, or 1600 protrude from the housing of the handheld rangefinder 1310 (e.g., the dongles may be similar or identical to dongle 910 described with reference to FIG. 9A). Further, in certain embodiments, more than one dongle may be attached to the handheld rangefinder 1310 at a time. Other versions of the dongles 1320, 1500, or 1600 may omit one or more components, may contain additional components, or both. For example, the connector 1530 may be omitted if the dongle 1600 wirelessly communicates with the handheld rangefinder 1310. By way of another example, the interface 1520 may be omitted if the handheld rangefinder 1310 is configured to identify a specific circuit on or within the dongle.

The system 1300 may be provided with external indicia, such as the external indicia described with reference to devices 700, 800, 900, and 1000, to help distinguish the various dongles (e.g., dongles 1320A-F) and provide an indication that one or more of the functionalities described above are being used with the handheld rangefinder 1310 and possibly which specific functionalities are being used. According to one embodiment, the dongles include an alert portion (e.g., similar to alert portion 811) that bears a visual indication, such as a color, light, or other visually perceptible item. A different color may be used for each dongle to help distinguish the various functionalities the dongles provide. According to another embodiment, the external indicia includes a light, such as a light similar or identical to the light described with reference to FIG. 11. The color of the light or a flashing pattern of the light may be altered depending on the functionality being used. According to other embodiments, the indication may be electronic. For example, the system 1300 may transmit a wireless signal indicating that the handheld rangefinder 1310 is being used with additional functionality and possibly an indication of the specific functionality that is being used. By way of another example, the system 1300 may log data (e.g., in memory 420 or a memory on a dongle) indicating that the handheld rangefinder 1310 was or was not used with additional functionality and possibly what functionality was used, if any. The data may be time and date stamped for future reference.

Although certain embodiments have been described with reference to portable handheld rangefinder for use with golfing, the embodiments described herein are equally applicable to other rangefinders, such as hunting and shooting rangefinders, tactical rangefinders, and observation rangefinders.

The methods and systems described herein may be implemented in and/or by any suitable hardware, software, firmware, or combination thereof. Accordingly, as used herein, a component or module may comprise hardware, software, and/or firmware (e.g., self-contained hardware or software components that interact with a larger system). A software module or component may include any type of computer instruction or computer executable code located within a memory device and/or transmitted as electronic signals over a system bus or wired or wireless network. A software module or component may, for instance, comprise one or more physical or logical blocks of computer instructions, which may be organized as a routine, program, object, component, data structure, etc., that performs one or more tasks or implements particular abstract data types.

The algorithms for operating the methods and systems illustrated and described herein may exist in a variety of forms both active and inactive. For example, they can exist as one or more software or firmware programs comprised of program instructions in source code, object code, executable code or other formats that may be executed by the processor 410 or another processor. A result or output from any step, such as a confirmation that the step has or has not been completed or an output value from the step, may be stored, displayed, printed, and/or transmitted over a wired or wireless network. For example, a line-of-sight distance along with additional information may be stored, displayed, or transmitted over a network.

Embodiments may be provided as a computer program product including a machine-readable storage medium having stored thereon instructions (in compressed or uncompressed form) that may be used to program a computer (or other electronic device) to perform processes or methods described herein. The machine-readable storage medium may include, but is not limited to, hard drives, floppy diskettes, optical disks, CD-ROMs, DVDs, read-only memories (ROMs), random access memories (RAMs), EPROMs, EEPROMs, flash memory, magnetic or optical cards, solid-state memory devices, or other types of media/machine-readable medium suitable for storing electronic instructions. Further, embodiments may also be provided as a computer program product including a machine-readable signal (in compressed or uncompressed form). Examples of machine-readable signals, whether modulated using a carrier or not, include, but are not limited to, signals that a computer system or machine hosting or running a computer program can be configured to access, including signals downloaded through the Internet or other networks. For example, distribution of software may be via CD-ROM or via Internet download.

The terms and descriptions used herein are set forth by way of illustration only and are not meant as limitations. Those skilled in the art will recognize that many variations can be made to the details of the above-described embodiments without departing from the underlying principles of the invention. The scope of the invention should therefore be determined only by the following claims (and their equivalents) in which all terms are to be understood in their broadest reasonable sense unless otherwise indicated.

The invention claaimed is:

1. A device for use by a player while golfing, the device comprising:

a rangefinder for determining a line-of-sight distance between the device and a target on a golf course;

a display;

a sensor for measuring one or more conditions affecting a play, the sensor different from the rangefinder; and a processor in communication with the rangefinder, the display, and the sensor, the processor configured to determine from data stored in a memory of a compliance module whether it is permissible to measure one or more conditions affecting a play using the sensor, wherein the compliance module is different from both the sensor and the processor, cause the sensor to measure the one or more conditions if it is determined that it is permissible to measure the one or more conditions, obtain additional information based on the one or more conditions measured by the sensor, and cause the display to indicate the line-of-sight distance and the additional information.

2. A device as set forth in claim 1, further comprising:

a compliance module in communication with the processor, the compliance module configured to provide the processor with an indication of whether it is permissible to measure one or more conditions affecting a play.

3. A device as set forth in claim 2, wherein the compliance module comprises a dongle configured to be detachably coupled to the device and to provide the processor with an indication of whether it is permissible to measure one or more conditions affecting a play after the dongle is detachably coupled to the device.

4. A device as set forth in claim 3 wherein the processor is further configured to interrogate the dongle to determine whether the dongle has stored thereon data indicating that it is permissible to measure one or more conditions affecting a play and the processor is configured to interrogate the dongle before the one or more conditions affecting a play are measured.

5. A device as set forth in claim 3 wherein the processor is further configured to authenticate the dongle by computing from data stored on the dongle a dongle message authentication code using a hash function stored on the dongle, computing from data stored on the device a device message authentication code using a hash function stored on the device, comparing the dongle and device message authentication codes, and authenticating the dongle if the dongle and device message authentication codes are identical.

6. A device as set forth in claim 2, wherein the compliance module comprises a switch housed inside of the device and the switch is configured to provide the processor with the indication of whether it is permissible to measure one or more conditions affecting a play after the switch is activation by the player and further comprising:

a token comprising a switch activation portion and an alert portion, the switch activation portion configured to activate the switch and the alert portion bearing a visual indication configured to notify others that the token is being used with the device.

7. A device as set forth in claim 2, wherein the compliance module comprises a receiver configured to provide the processor with an indication of whether it is permissible to measure one or more conditions affecting a play after the receiver receives a signal from a wireless transmitting system.

8. A device as set forth in claim 2, wherein:

the memory stores data concerning whether it is permissible to measure one or more conditions affecting a play based on a geographic location of the device, and wherein the compliance module comprises a GPS receiver configured to provide the processor with a current geographic location of the device, and wherein the processor is further configured to determine whether it is permissible to measure one or more conditions affecting a play based upon the current geographic location of the device provided by the GPS receiver and the data stored in the memory.

9. A device as set forth in claim 8, further comprising:

an override module in communication with the processor and configured to provide the processor with an indication that it is permissible to measure one or more conditions affecting a play regardless of the geographic location of the device provided by the GPS receiver and the data stored in the memory.

10. A device as set forth in claim 1, further comprising:

external indicia configured to notify others whether one or more conditions affecting a play are being measured.

11. A device as set forth in claim 10, wherein the external indicia comprises a brightly colored dongle configured to be attached to the device.

12. A device as set forth in claim 10, wherein the external indicia comprises a light.

13. A device as set forth in claim 1, further comprising:

a transmitter in communication with the processor and configured to notify others whether one or more conditions affecting a play is being measured.

14. A device as set forth in claim 1, wherein the sensor is selected from the group comprising an inclinometer, a GPS receiver, a temperature sensor, a humidity sensor, an altimeter, an anemometer, a compass, and a barometer.

15. A device as set forth in claim 1, wherein the additional information is selected from the group comprising a true distance, a suggested club, a suggested swing speed, a ball type, a hitter ability, a hitting distance, a handicap, a temperature, an angle of inclination, a ground slope, a course layout, a humidity, an altitude, a wind speed, a compass direction, a barometric pressure, air density, a geographic location of the device, and a combination thereof.

16. A method of using an electronic device in aid of golfing, the method comprising:

determining a line-of-sight distance between the electronic device and a target on a golf course;

determining from a memory of a compliance module whether it is permissible to measure one or more conditions affecting a play;

measuring, if permissible, one or more conditions affecting a play;

determining, via an internal processor of the electronic device, additional information affecting a player's attempt to move a ball toward the target based upon said one or more measured conditions; and displaying the line-of-sight distance and the additional information on a display of the electronic device.

17. A method according to claim 16, wherein the step of determining whether it is permissible to measure one or more conditions affecting a play comprises determining whether a dongle detachably coupled to the device has stored thereon data indicating that it is permissible to measure one or more conditions affecting a play.

18. A method of using an electronic device in aid of golfing, the method comprising:

determining a line-of-sight distance between the electronic device and a target on a golf course;

determining from a compliance module whether it is permissible to measure one or more conditions affecting a play;

measuring, if permissible, one or more conditions affecting a play;

determining, via an internal processor of the electronic device, additional information affecting a player's attempt to move a ball toward the target based upon said one or more measured conditions;

displaying the line-of-sight distance and the additional information on a display of the electronic device; and notifying others, via an external indicia associated with the device, whether one or more conditions affecting a play is being measured.

19. A method according to claim 16, further comprising:

storing in a memory of the device an indication of whether one or more conditions affecting a play is measured to facilitate determining whether the device is used in compliance with local rules of golf 20. A modular rangefinder device, comprising:

a range sensor configured to determine a line-of-sight distance between the modular rangefinder device and an object;

a display;

an interface configured to communicatively connect a dongle to the modular rangefinder device, wherein (1) the dongle includes a memory having stored thereon one or more permission parameters that cause the modular rangefinder device to operate in one of a plurality of modes of operation associated with the dongle when the dongle is detachably coupled to the modular rangefinder device, (2) additional information other than the line-of-sight distance is presented via the display when the modular rangefinder device operates in said one of the plurality of modes of operation associated with the dongle, and (3) the additional information is determined based on the line-of-sight distance and a condition measured by a first sensor that is different from the range sensor; and a processor in communication with the range sensor, the first sensor, the display, and the interface, wherein the processor is configured to determine whether the dongle to determine whether the dongle includes one or more permission parameters and if it is determined that the dongle includes one or more permission parameters, the processor is further configured to cause the range sensor to determine the line-of-sight distance, cause the first sensor to measure the condition, determine the additional information based on the line-of-sight distance and the condition measured by the first sensor, and present via the display the additional information to thereby cause the modular rangefinder device to operate in said one of the plurality of modes of operation associated with the dongle when the dongle is detachably coupled to the modular rangefinder device.

21. A device as set forth in claim 20, further comprising:

external indicia configured to notify others when the modular rangefinder device is operating in said one of the plurality of modes of operation associated with the dongle.

22. A device as set forth in claim 20, wherein the first sensor is installed on the dongle.

23. A device as set forth in claim 22, further comprising:

an alignment device configured to align the first sensor with the modular rangefinder device.

24. A device as set forth in claim 22, wherein the processor is further configured to calibrate the first sensor after the dongle is detachably coupled to the modular rangefinder device.

25. A device as set forth in claim 20, the memory further having stored thereon one or more permission parameters that cause the modular rangefinder device to operate in a golf mode in which the first sensor measures one or more conditions affecting a trajectory of a golf ball as the golf ball travels from the modular rangefinder device to the object and the additional information determined by the processor and presented via the display assists a golfer in making a play based on the one or more conditions affecting the trajectory of the golf ball.

26. A device as set forth in claim 20, the memory further having stored thereon one or more permission parameters that cause the modular rangefinder device to operate in a ballistic mode in which the first sensor measures one or more conditions affecting a trajectory of a projectile as the projectile travels from the modular rangefinder device to the object and the additional information determined by the processor and presented via the display facilitates inclined shooting of projectile weapons based on the one or more conditions affecting the trajectory of the projectile.

27. A dongle for use with a modular rangefinder device, the dongle comprising:

a memory having stored thereon one or more permission parameters that cause the modular rangefinder device to operate in one of a plurality of modes of operation associated with the dongle when the dongle is detachably coupled to the modular rangefinder device; and an interface configured to communicatively connect the dongle to the modular rangefinder device, wherein the modular rangefinder device includes (1) a range sensor configured to determine a line-of-sight distance between the modular rangefinder device and an object, (2) a display, and (3) a processor configured to determine whether the dongle includes one or more permission parameters and if it is determined that the dongle includes one or more permission parameters, the processor is further configured to cause the range sensor to determine the line-of-sight distance, cause a first sensor that is different from the range sensor to measure a condition, determine additional information based on the line-of- sight distance and the condition measured by the first sensor, and present via the display the additional information to thereby cause the modular rangefinder device to operate in said one of the plurality of modes of operation associated with the dongle when the dongle is detachably coupled to the modular rangefinder device.

28. A dongle as set forth in claim 27, wherein the first sensor is installed on the dongle.

29. A dongle as set forth in claim 27, wherein the one or more permission parameters stored in the memory cause the modular rangefinder device to operate in a golf mode in which the first sensor measures one or more conditions affecting a trajectory of a golf ball as the golf ball travels from the modular rangefinder device to the object and the additional information determined by the processor and presented via the display assists a golfer in making a play based on the one or more conditions affecting the trajectory of the golf ball.

30. A dongle as set forth in claim 27, the one or more permission parameters stored in the memory cause the modular rangefinder device to operate in a ballistic mode in which the first sensor measures one or more conditions affecting a trajectory of a projectile as the projectile travels from the modular rangefinder device to the object and the additional information determined by the processor and presented via the display facilitates inclined shooting of projectile weapons based on the one or more conditions affecting the trajectory of the projectile.

* * * * *